US010059025B2

(12) United States Patent
Baek et al.

(10) Patent No.: US 10,059,025 B2
(45) Date of Patent: Aug. 28, 2018

(54) STAPLING APPARATUS AND IMAGE FORMING APPARATUS INCLUDING THE SAME

(71) Applicant: S-PRINTING SOLUTION CO., LTD., Suwon-si, Gyeonggi-do (KR)

(72) Inventors: Tae-jin Baek, Suwon-si (KR); Tae-hong Kim, Yongin-si (KR); Seoung-uk Han, Goyang-si (KR); Eiji Fukasawa, Suwon-si (KR); Dong-sun Jung, Seoul (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/674,024

(22) Filed: Aug. 10, 2017

(65) Prior Publication Data

US 2018/0111285 A1 Apr. 26, 2018

(30) Foreign Application Priority Data

Oct. 20, 2016 (KR) ..... 10-2016-0136195

(51) Int. Cl.
*B65H 37/04* (2006.01)
*B27F 7/23* (2006.01)
*G03G 15/00* (2006.01)

(52) U.S. Cl.
CPC ..... *B27F 7/23* (2013.01); *G03G 15/6544* (2013.01); *G03G 2215/00827* (2013.01)

(58) Field of Classification Search
CPC ..... B65H 37/04; B65H 2408/122; B65H 2408/1222; G03G 2215/00827; G03G 2215/00848; G03G 2215/00864; B42C 1/12; B31F 5/001; B41L 43/12
USPC ..... 270/37, 58.08, 58.09; 410/399
See application file for complete search history.

(56) References Cited

U.S. PATENT DOCUMENTS 5,911,414 A * 6/1999 Kato ..... B26F 1/10 234/38
6,264,189 B1 7/2001 Kawata
6,427,997 B1 * 8/2002 Hirota ..... B42C 1/12 270/58.12
6,474,633 B1 * 11/2002 Hirai ..... B25C 5/1658 221/197
7,419,150 B2 * 9/2008 Kushida ..... B42C 1/12 270/58.07
8,398,067 B2 3/2013 Furuhashi et al.
8,517,368 B1 * 8/2013 Brundige ..... G03G 15/6544 270/58.07
8,613,382 B2 12/2013 Jung
2011/0031675 A1 2/2011 Terao
2012/0037685 A1 2/2012 Jung
(Continued)

FOREIGN PATENT DOCUMENTS

JP 2012-180151 9/2012
JP 5569793 8/2014
(Continued)

*Primary Examiner* — Leslie A Nicholson, II
(74) *Attorney, Agent, or Firm* — Staas & Halsey LLP

(57) ABSTRACT

A stapling apparatus capable of performing stapling on various positions by varying a moving path of a stapler is provided. The stapling apparatus includes a stapler, a driver configured to be coupled to the stapler and move the stapler, and a guide part configured to selectively switch a moving path of the stapler.

20 Claims, 28 Drawing Sheets

(56) References Cited

U.S. PATENT DOCUMENTS

| | | | | |
|---|---|---|---|---|
| 2015/0368061 | A1 | 12/2015 | Lee et al. | |
| 2017/0233213 | A1 * | 8/2017 | Ahn | B65H 37/04 |

FOREIGN PATENT DOCUMENTS

| | | | | |
|---|---|---|---|---|
| JP | 5691478 | | | 4/2015 |
| JP | 5857635 | | | 2/2016 |
| KR | 20120015626 | A | * | 2/2012 |
| KR | 10-1207807 | | | 12/2012 |
| WO | WO-WO2006038530 | | | 5/2003 |

* cited by examiner

STAPLING APPARATUS AND IMAGE FORMING APPARATUS INCLUDING THE SAME

CROSS-REFERENCE TO RELATED APPLICATIONS

This application claims priority from Korean Patent Application No. 10-2016-0136195, filed on Oct. 20, 2016, in the Korean Intellectual Property Office, the disclosure of which is incorporated herein by reference in its entirety.

BACKGROUND

1. Field

Apparatuses described herein with respect to the disclosure relate to a stapling apparatus of which a stapling position is varied, and an image forming apparatus including the same.

2. Description of the Related Art

An image forming apparatus refers to an apparatus that prints images on printing media on the basis of an input image signal through an image former, and may be a printer, a copier, a scanner, a facsimile, or the like, or may be a multi-functional peripheral (MFP) in which functions of the printer, the copier, the scanner, and the facsimile are complexly implemented through one apparatus.

A recent image forming apparatus may include a stapling apparatus that staples printing media on which formation of the images is completed through a stapler, a binding apparatus that bind the printing media in a book form by folding central portions of the printing media, and the like, for convenience of a user, to post-process the printing media on which the formation of the images are completed. The stapling apparatus or the binding apparatus may be included in a post-processing apparatus and be coupled to a body of the image forming apparatus.

In the stapling apparatus according to the related art, a position of the stapler is fixed, such that stapling is performed on specific positions of the printing media discharged from the image former, and the stapler moves along a predetermined path, such that the stapling may be performed on different positions of the printing media.

However, in the stapling apparatus according to the related art, a moving path of the stapler is limited, such that stapling may not be performed on desired positions of various kinds of printing media having various sizes.

SUMMARY

Exemplary embodiments of the disclosure overcome the above disadvantages and other disadvantages not described above. Also, the disclosure is not required to overcome the disadvantages described above, and an exemplary embodiment of the disclosure may not overcome any of the problems described above.

The disclosure provides a stapling apparatus capable of performing stapling on various positions by varying a moving path of a stapler, and an image forming apparatus including the same.

According to an aspect of the disclosure, a stapling apparatus includes: a stapler, a driver configured to be coupled to the stapler and to move the stapler, and a guide part configured to selectively change a configuration of a moving path so as to define the moving path along which the stapler can be moved by the driver.

The guide part may include a main slot, first and second branch slots configured to be branched from one end portion of the main slot, and a switching lever configured to selectively change the configuration of the moving path by selectively opening or closing the first and second branch slots.

The guide part may further include first and second rollers configured to be coupled to the stapler and to be slidably inserted into the main slot.

The first branch slot may be inclined from the main slot.

The first branch slot may include at least one bent section.

The second branch slot may be extended along in a same direction as that of the main slot.

The switching lever may rotate about a shaft so that one end portion of the switching lever selectively opens or closes one side of each of the first and second branch slots connected to one end portion of the main slot, and the shaft is disposed at an other end portion of the switching lever.

The guide part may further include a rotation driving unit configured to rotate the switching lever.

The rotation driving unit may include: a connection member configured to have one end portion of the connection member coupled to the shaft of the switching lever, and a solenoid configured to be coupled to an other end portion of the connection member.

The guide part may further include third and fourth branch slots configured to be branched from an other end portion of the main slot, and another switching lever may be configured to selectively change the configuration of the moving path by selectively opening or closing the third and fourth branch slots.

The rotation driving unit may further include: a first pinion gear configured to be coupled to a shaft of the first switching lever, a first rack gear configured to have one end portion engaged with the first pinion gear, a second pinion gear configured to be coupled to a shaft of the second switching lever, a second rack gear configured to have one end portion engaged with the second pinion gear, a driving pinion gear configured to be engaged with the other end portion of the first rack gear and the other end portion of the second rack gear, and a motor configured to rotate the driving pinion gear.

The stapling apparatus may further include a controller configured to control an operation of the rotation driving unit, wherein the controller rotates the rotation driving unit so that the switching lever rotates in a direction in which the switching lever closes the first branch slot when the first roller disposed in front of the second roller in a moving direction of the stapler enters the first branch slot.

The first roller may be disposed in front of the second roller in a moving direction of the stapler and the first and second rollers may move along the first and second branch slots, respectively.

The switching lever may further include an elastic member configured to apply force to the switching lever so that the switching lever rotates in a first direction in which the switching lever closes the second branch slot.

The switching lever may further include a protrusion part configured to protrude from the other end portion of the switching lever toward an inner side of the first branch slot, and the protrusion part may be pressed by the first roller entering the first branch slot, such that the switching lever rotates a second direction in which the switching lever closes the first branch slot.

The other end portion of the first branch slot and the other end portion of the second branch slot may be connected to each other so that the first branch slot and the second branch slot form a closed loop, and the first roller may sequentially move along the main slot, the first branch slot, the second branch slot, and the main slot.

The guide part may further include a blocking lever configured to open or close the other end portion of the first branch slot, and the blocking lever may block the first roller from entering the first branch slot from the second branch slot.

The blocking lever may rotate around a shaft disposed at the other end portion thereof so that one end portion thereof opens or closes the other end portion of the first branch slot, and may be supported by an inner sidewall of the first branch slot in a state in which one end portion thereof closes the other end portion of the first branch slot.

The blocking lever may include a blocking elastic member applying force to the blocking lever so that the blocking lever rotates in a third direction in which the blocking lever closes the other end portion of the first branch slot, and the first roller moving the first branch slot may press one end portion of the blocking lever to rotate the blocking lever in a fourth direction in which the blocking lever opens the other end portion of the first branch slot, thereby moving to the second branch slot.

According to another aspect of the disclosure, a stapling apparatus includes: a stapler, a driver configured to be coupled to the stapler and to move the stapler, and a guide part configured to selectively change a configuration of a moving path so as to define the moving path along which the stapler can be moved by the driver. The guide part may include a main slot, an extension slot configured to be extended from the main slot, and a switching lever configured to be rotatably disposed in the extension slot to partition the extension slot into a first branch slot and a second branch slot.

The guide part may further include first and second rollers configured to be coupled to the stapler and to be slidably inserted into the main slot, and the first roller may be disposed in front of the second roller in a moving direction of the stapler.

The switching lever may have opposite end portions in selective contact with inner sidewalls of the extension slot to partition the extension slot into the first branch slot and the second branch slot.

One end portion of the switching lever adjacent to the main slot may be in selective contact with inner sidewalls of the extension slot facing each other depending on rotation of the switching lever to selectively open or close the first and second branch slots.

The switching lever may further include an elastic member configured to apply force to the switching lever so that one end portion of the switching lever rotates in a first direction in which one end portion of the switching lever closes the second branch slot, and as the first roller presses the other end portion of the switching lever while moving along the first branch slot, the switching lever may rotate in a second direction in which the switching lever closes the first branch slot so that the second roller enters the second branch slot.

In addition, the extension slot may further include an accommodating groove configured to be disposed adjacently to the other end portion of the switching lever, and when the switching lever rotates in the second direction, the first branch slot and the accommodating groove may be connected to each other, and when the first roller moves from the first branch slot to the accommodating groove, the switching lever may be released from being pressed from the first roller, such that the switching lever rotates in the first direction so that the accommodating groove and the second branch slot are connected to each other.

According to still another aspect of the disclosure, an image forming apparatus may include: a body configured to include an image former, and a stapling apparatus configured to staple printing media discharged from the image former. The stapling apparatus may include: a stapler, a driver configured to move the stapler, and a guide part configured to guide the stapler when the driver moves the stapler, the guide part including a main slot, first and second branch slots configured to be branched from one end portion of the main slot, and a switching lever configured to selectively open or close the first and second branch slots so that the driver can selectively move the stapler from the main slot to the first and second branch slots.

According to still another aspect of the disclosure, a stapling apparatus, comprising: a stapler configured to staple a document, a driver configured to move the stapler between a plurality of stapling positions to enable the stapler to perform stapling of the document at different angles and at different positions of the document, and a guide part configured to guide the stapler when the driver moves the stapler, the guide part including: a main slot, extending in a horizontal direction, configured to guide the stapler back and forth along the main slot, a first branch slot, extending in a first inclined direction away from a first end portion of the main slot, configured to guide rotation of the stapler to a first stapling position among the plurality of stapling positions to enable the stapler to perform stapling of the document at a first position of the document and at a first inclined direction, and a second branch slot, extending in a second inclined direction away from a second end portion of the main slot, configured to guide rotation of the stapler to a second stapling position among the plurality of stapling positions to enable the stapler to perform stapling of the document at a second position of the document and at a second inclined direction.

The guide part may further includes a third branch slot, extending in the horizontal direction away from an intersection of the first branch slot and the first end portion of the main slot, and a switching lever, disposed between the first branch slot and the third branch slot, configured to close off the first branch slot from the main slot when the stapler moves along the third branch slot, and configured to close off the third branch slot from the main slot when the stapler moves along the first branch slot.

BRIEF DESCRIPTION OF THE DRAWINGS

The above and/or other aspects of the disclosure will be more apparent by describing certain exemplary embodiments of the disclosure with reference to the accompanying drawings, in which.

DETAILED DESCRIPTION

Figure 1:
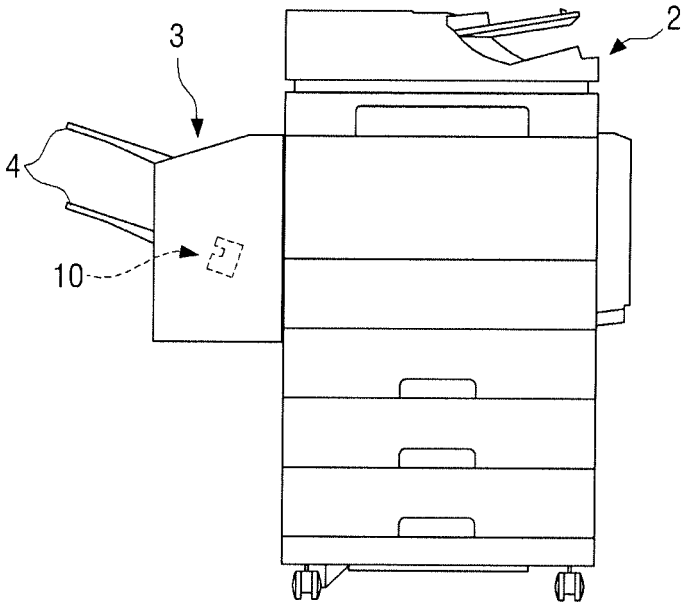
FIG. 1 is a view schematically illustrating an image forming apparatus including a stapling apparatus according to an exemplary embodiment of the disclosure.

Hereinafter, exemplary embodiments of the disclosure will be described in detail with reference to the accompanying drawings. Exemplary embodiments to be described below will be described on the basis of exemplary embodiments most appropriate for understanding technical features of the disclosure, and these exemplary embodiments do not limit the technical features of the disclosure, but exemplify that the disclosure may be implemented like these exemplary embodiments.

Therefore, the disclosure may be variously modified without departing from the technical scope of the disclosure through exemplary embodiments to be described below, and these modifications will be to fall within the technical scope of the disclosure. In addition, to assist in the understanding of exemplary embodiments to be described below, components performing the same operations and related components in the respective exemplary embodiments will be denoted by the same or similar reference numerals throughout the accompanying drawings.

FIG. 1 is a view schematically illustrating an image forming apparatus 1 including a stapling apparatus 10 according to an exemplary embodiment of the disclosure.

The image forming apparatus 1 according to an exemplary embodiment of the disclosure may be a printer, a copier, a scanner, a facsimile, or the like, or may be a multi-functional peripheral (MFP) in which functions of the printer, the copier, the scanner, and the facsimile are complexly implemented through one apparatus. Hereinafter, a case in which the image forming apparatus 1 is the MFP will be described by way of example for convenience of explanation.

The image forming apparatus 1 may include a body 2 and a post-processing apparatus 3 coupled to the body.

The post-processing apparatus may perform post-processing such as stapling of printing media (not illustrated) on which formation of images is completed through a stapler, binding of the printing media in a book form by folding of central portions of the printing media, or the like, and may load the printing media on which the post-processing is completed in a plurality of trays 4.

As illustrated in FIG. 1, the post-processing apparatus 3 may include the stapling apparatus 10.

The stapling apparatus 10 may staple the printing media on which images are formed through an image former of the body 2. Here, the stapling refers to weaving and fixing a plurality of printing media through a staple such as a staple formed of a metal.

Figure 2:
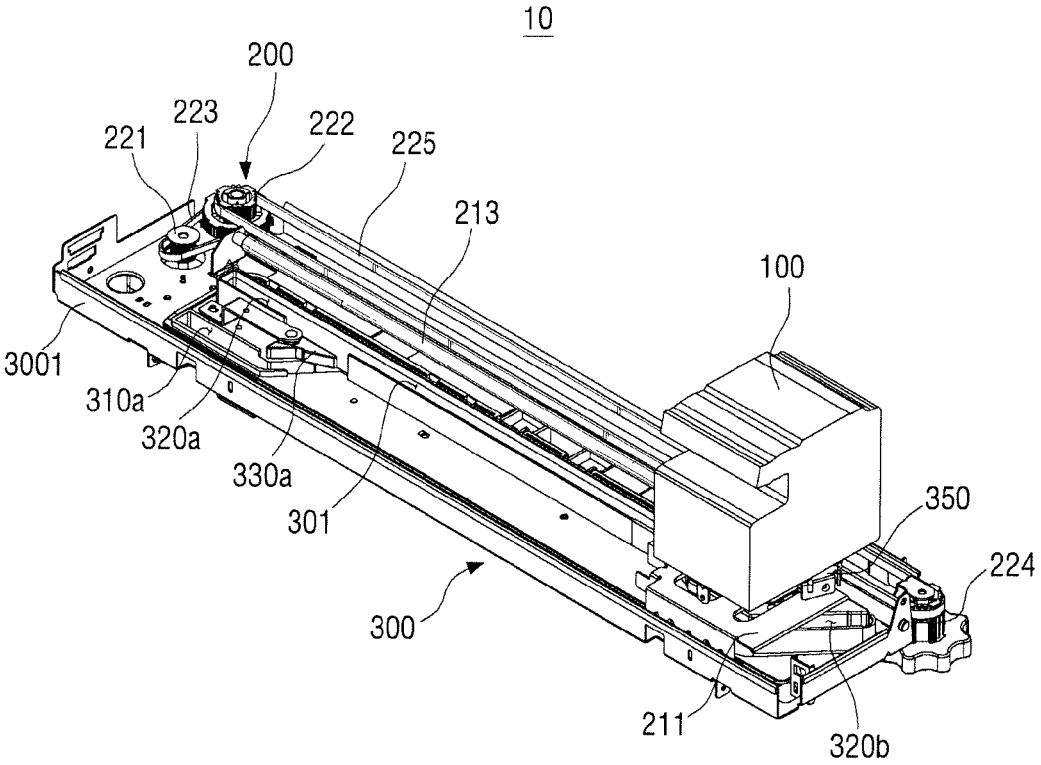
FIG. 2 is a perspective view illustrating the stapling apparatus illustrated in FIG. 1.
Figure 3:
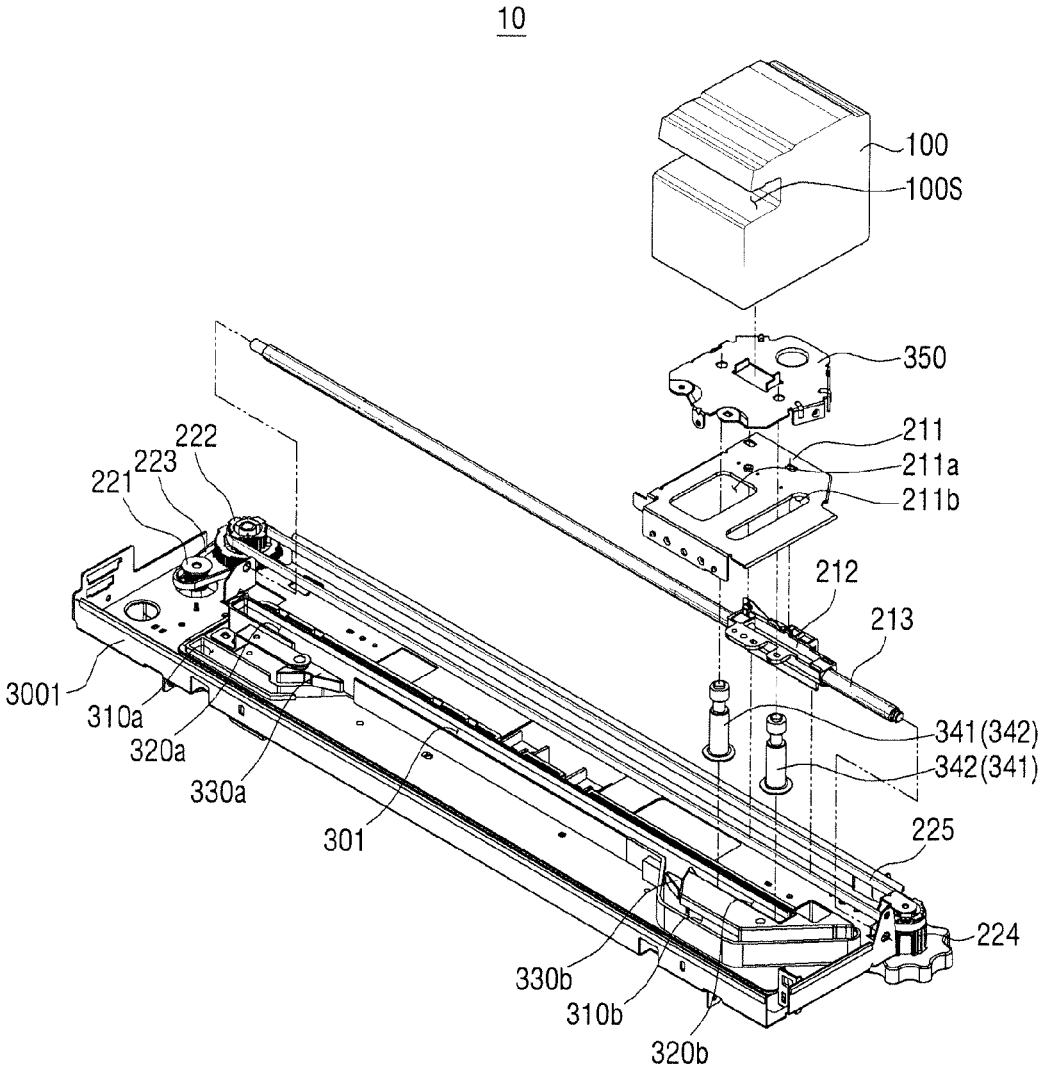
FIG. 3 is an exploded perspective view of the stapling apparatus illustrated in FIG. 2.

FIG. 2 is a perspective view illustrating the stapling apparatus 10 schematically illustrated in FIG. 1, and FIG. 3 is an exploded perspective view of the stapling apparatus 10 illustrated in FIG. 2.

Hereinafter, a structure of the stapling apparatus 10 will be described in detail with reference to FIGS. 2 and 3.

The stapling apparatus 10 may include a stapler 100, a driver 200 coupled to the stapler 100 and moving the stapler 100, and a guide part 300 selectively switching a moving path of the stapler 100.

The stapler 100 may staple a printing medium disposed in a stapling groove 100S, and may be electronically controlled through a controller (not illustrated) to move to a desired position and then staple the printing medium.

However, since the stapler 100 is the same as or similar to a stapler generally widely used in the post-processing apparatus 3, a detailed description therefor will be omitted.

The stapler 100 may be coupled to the driver 200 and move in a horizontal direction through the driver 200, and the moving path of the stapler 100 may be selectively switched through the guide part 300.

The driver 200 may include a moving plate 211, a moving member 212, a moving shaft 213, a first pulley 221, a second pulley 222, a first driving belt 223, a third pulley 224, a second driving belt 225, and a driving motor (not illustrated).

In detail, the moving plate 211 is coupled to the stapler 100.

In detail, the moving member 212 slidably coupled to the moving shaft 213 extended in the horizontal direction of the stapling apparatus 10 is coupled to the moving plate 211 coupled to the stapler 100.

The first pulley 221 is coupled to and rotates by the driving motor, and the first pulley 221 and the second pulley 222 are connected to each other through the first driving belt 223, such that torque of the first pulley 221 may be transferred to the second pulley 222.

In addition, the second pulley 222 and the third pulley 224 are disposed, respectively, at opposite ends of the stapling apparatus 10 in the horizontal direction, and are connected to each other through the second driving belt 225.

Therefore, the second driving belt 225 may rotate in the horizontal direction of the stapling apparatus 10.

The moving member 212 may be coupled to the second driving belt 225, and move in the horizontal direction depending on rotation of the second driving belt 225.

In addition, the moving member 212 may be slidably coupled to the moving shaft 213 to stably move along the moving shaft 213.

To this end, it is preferable that the moving shaft 213 and the second driving belt 225 are disposed in parallel with each other in the horizontal direction of the stapling apparatus 10.

Therefore, the moving plate 211 coupled to the moving member 212 may reciprocate in the horizontal direction of the stapling apparatus 10, and the stapler 100 coupled to the moving plate 211 may reciprocate in the horizontal direction of the stapling apparatus 10.

In addition, the moving plate 211 is coupled to the moving member 212 fastened to the moving shaft 213 and slides along the moving shaft 213 and moves in the horizontal direction, such that the stapler 100 may stably move without being shaken.

In addition, an operation of the driving motor is controlled through the controller, such that a position of the stapler 100 may be manipulated.

A structure of the driver 200 may be modified into various structures that may move the stapler 100 in the horizontal direction of the stapling apparatus 10, in addition to the structure described above.

The guide part 300 may include a guide plate 3001, and a slot guiding movement of the stapler 100 is formed in the guide plate 3001.

As illustrated in FIGS. 2 and 3, the guide plate 3001 may have a quadrangular plate shape, and the driver 200 may be disposed on the guide plate 3001.

The guide plate 3001 may include a main slot 301 formed at the center thereof, and first branch slots 310*a* and 310*b* and second branch slots 320*a* and 320*b* branched from one end portion of the main slot 301.

The main slot 301 may be extended in the horizontal direction of the stapling apparatus 10 like the moving shaft 213, and the first branch slots 310*a* and 310*b* and the second branch slots 320*a* and 320*b* may be branched from one end portion of the main slot 301 at various angles and in various directions.

The first and second branch slots may be branched from one position of the main slot 301, such that the number of each of first and second branch slots may be one, or the first and second branch slots may be branched from several position of the main slot 301, such that the number of each of first and second branch slots may be plural.

For example, as illustrated in FIGS. 2 and 3, the first branch slots 310*a* and 310*b* and the second branch slots 320*a* and 320*b* may be branched from opposite sides of the main slot 310, respectively. In detail, the first and second branch slots 310*a* and 320*a* may be branched from one end portion of the main slot 301, and the first and second branch slots 310*b* and 320*b* may be branched from the other end portion of the main slot 301.

Figure 4:
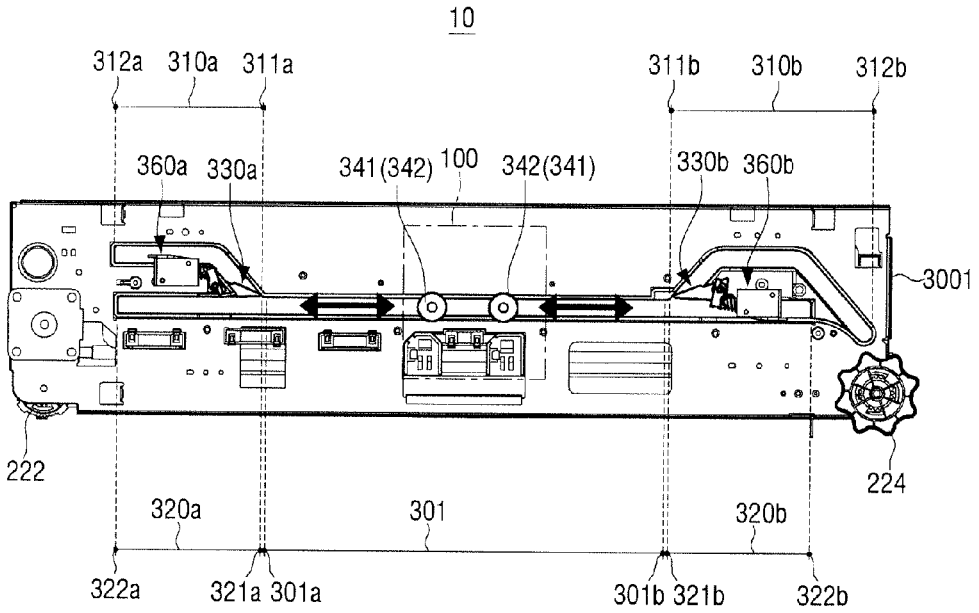
FIG. 4 is a bottom view of the stapling apparatus illustrated in FIG. 2.

In addition, the first and second branch slots 310*a* and 320*a* branched from one end portion of the main slot 301 and the first and second branch slots 310*b* and 320*b* branched from the other end portion of the main slot 301 may be disposed symmetrically to each other in the same shape, or be configured in different shapes as illustrated in FIG. 4 to be described below.

The guide part 300 may include switching levers 330*a* and 330*b* selectively opening or closing the first branch slots 310*a* and 310*b* and the second branch slots 320*a* and 320*b*.

The switching levers 330*a* and 330*b* may be rotatably coupled to the guide plate 3001 and rotate to selectively open or close the first branch slots 310*a* and 310*b* and the second branch slots 320*a* and 320*b*. Therefore, the moving path of the stapler 100 moving along the main slot 301, the first branch slots 310*a* and 310*b*, and the second branch slots 320*a* and 320*b* may be selectively switched.

In addition, the guide part 300 may include a roller slidably inserted into the main slot 301 and moving along the main slot 301.

The roller may include first and second rollers 341 and 342 as illustrated in FIGS. 2 and 3 or may be a single roller.

Hereinafter, for convenience of explanation, a roller disposed at the front in the moving direction of the stapler 100, of the first and second rollers 341 and 342, will be referred to as a first roller 341, and a roller disposed at the rear in the moving direction of the stapler 100, of the first and second rollers 341 and 342, will be referred to as a second roller 342.

Since the stapler 100 may reciprocate in the horizontal direction of the stapling apparatus 10, names of the first roller 341 and the second roller 342 may be exchanged with each other depending on the moving direction of the stapler 100.

One end portions of the first and second rollers 341 and 342 may be coupled to the stapler 100 and the other end portions thereof may be inserted into the main slot 301 to move along the main slot 301, the first branch slots 310*a* and 310*b*, and the second branch slots 320*a* and 320*b*.

The first and second rollers 341 and 342 may move in the horizontal direction of the stapling apparatus 10 by the driver 200 moving the stapler 100.

As illustrated in FIG. 3, the moving plate 211 coupled to the moving member 212 may include first and second hollows 211*a* and 211*b* formed therein.

One end portions of the first and second rollers 341 and 342 may penetrate through the first and second hollows 211*a* and 211*b*, respectively, and be then coupled to the stapler 100.

In addition, the first and second rollers 341 and 342 and the stapler 100 may be coupled to each other through a connection plate 350 disposed therebetween. In detail, one end portions of the first and second rollers 341 and 342 are coupled to the connection plate 350, and the connection plate 350 is coupled to the stapler 100, such that the first and second rollers 341 and 342 and the stapler 100 may be coupled to each other.

The first and second hollows 211*a* and 211*b* may have diameters greater than those of the first and second rollers 341 and 342 so that the first and second rollers 341 and 342 may move in the first and second hollows 211*a* and 211*b*, respectively.

Therefore, the first and second rollers 341 and 342 connected to the moving plate 211 and moving in the horizontal direction may also move in a vertical direction along the first branch slots 310*a* and 310*b* and the second branch slots 320*a* and 320*b*, and the stapler 100 may also move in the vertical direction, in addition to the horizontal direction.

In addition, the stapler 100 coupled to the first and second rollers 341 and 342 may rotate while moving along the first branch slots 310*a* and 310*b* and the second branch slots 320*a* and 320*b* by the first and second rollers 341 and 342 moving in the first and second hollows 211*a* and 211*b*.

Therefore, the main slot 301 may be extended to various paths through the first branch slots 310*a* and 310*b* and the second branch slots 320*a* and 320*b*, and the moving path of the stapler 100 that may move along the main slot 301, the first branch slots 310*a* and 310*b*, and the second branch slots 320*a* and 320*b* may be diversified.

A structure in which the moving path of the stapler 100 is selectively switched along the main slot 301, the first branch slots 310*a* and 310*b*, and the second branch slots 320*a* and 320*b* will be described in detail below.

FIG. 4 is a bottom view of the stapling apparatus 10 illustrated in FIG. 2.

Hereinafter, structures of the main slot 301, the first branch slots 310*a* and 310*b*, the second branch slots 320*a* and 320*b*, and the switching levers 330*a* and 330*b* will be described with reference to FIG. 4.

In FIG. 4, the stapler 100 disposed on a rear surface of the guide plate 3001 is denoted by a dotted line.

As illustrated in FIG. 4, the first branch slot 310*a* branched from one end portion 301*a* of the main slot 301 may be branched in an inclined form from one end portion 301*a* of the main slot 301. Therefore, the first and second rollers 341 and 342 pass through an inclined section of the first branch slot 310*a*, such that the stapler 100 may rotate at a predetermined angle.

In addition, the first branch slot 310*a* may include at least one bent section.

In detail, the first branch slot 310*a* may include the inclined section formed from one end portion 311*a* thereof connected to one end portion 301*a* of the main slot 301 and the bent section formed after the inclined section to again move the first and second rollers 341 and 342 in the horizontal direction.

Therefore, the stapler 100 passing through the first branch slot 310*a* may rotate at a predetermined angle while passing through the inclined section, and may then again rotate to correspond to the horizontal direction of the stapling apparatus 10 while passing through the bent section.

In addition, the second branch slot 320*a* is formed on the same straight line as that of the main slot 301.

In detail, the second branch slot 320*a* may be extended from one end portion 301*a* of the main slot 301 in the horizontal direction. Therefore, the main slot 301 may be extended from one end portion 321*a* of the second branch slot 320*a* to the other end portion 322*a* thereof.

A moving distance of the stapler 100 in the horizontal direction may be increased through the second branch slot 320*a*. Therefore, a distance at which stapling may be performed in the horizontal direction may be expanded. Therefore, the stapling may be performed on printing media having various sizes as compared with the related art.

In addition, the guide part 300 may further include the first branch slot 310*b* and the second branch slot 320*b* branched from the other end portion 301*b* of the main slot 301 opposed to one end portion 301*a* of the main slot 301.

The first branch slot 310*b* branched from the other end portion 301*b* of the main slot 301 may also be branched in an inclined form from the other end portion 301*b* of the main slot 301 like the first branch slot 310*a* branched from one end portion 301*a* of the main slot 301.

Therefore, the first and second rollers 341 and 342 pass through an inclined section of the first branch slot 310*b*, such that the stapler 100 may rotate. Therefore, an angle at which the stapling is performed on the printing medium may be changed.

In addition, as illustrated in FIG. 4, the first branch slot 310*b* branched from the other end portion 301*b* of the main slot 301 may include a plurality of bent sections disposed on a path from one end portion 311*b* of the first branch slot 310*b* to the other end portion 312*b* thereof.

Therefore, a position and an angle of the stapler 100 moving along the first branch slot 310*b* may be more variously adjusted.

In addition, the second branch slot 320*b* branched from the other end portion 301*b* of the main slot 301 may be formed on the same straight line as that of the main slot 301 like the second branch slot 320*a* branched from one end portion 301*a* of the main slot 301.

Therefore, the second branch slot 320*b* may be extended from the other end portion 301*b* of the main slot 301 in the horizontal direction, and the main slot 301 may be extended from one end portion 321*b* of the second branch slot 320*b* to the other end portion 322*b* thereof.

As described above, the first and second branch slots branched from the main slot 301 may be branched from only any one of one end portion and the other end portion of the main slot 301 or may be branched from opposite end portions of the main slot 301 as illustrated in FIG. 4.

In addition, the first and second branch slots may be branched from a central portion of the main slot 301 or various positions of the main slot 301, in addition to opposite end portions of the main slot 301 in the horizontal direction.

As described above, paths of the first and second rollers 341 and 342 may be extended or diversified through the first and second branch slots branched from various positions of the main slot 301. Therefore, the moving path of the stapler 100 may also be extended or be diversified.

In addition, as illustrated in FIG. 4, the switching levers 330*a* and 330*b* may be disposed between the first branch slots 310*a* and 310*b* and the second branch slots 320*a* and 320*b*, respectively.

The switching levers 330*a* and 330*b* may selectively open or close the first branch slots 310*a* and 310*b* and the second branch slots 320*a* and 320*b*, respectively, to selectively move the first and second rollers 341 and 342 from the main slot 301 to the first branch slots 310*a* and 310*b* or the second branch slots 320*a* and 320*b*.

The guide part 300 may further include rotation driving units 360*a* and 360*b* each rotating the switching levers 330*a* and 330*b*, and the switching levers 330*a* and 330*b* may rotate in a clockwise direction or a counterclockwise direction through the rotation driving units 360*a* and 360*b*, respectively, to selectively open or close the first branch slots 310*a* and 310*b* and the second branch slots 320*a* and 320*b*, respectively.

A structure of selectively opening or closing the first branch slots 310*a* and 310*b* and the second branch slots 320*a* and 320*b* through the switching levers 330*a* and 330*b* will be described in detail below.

Figure 5A:
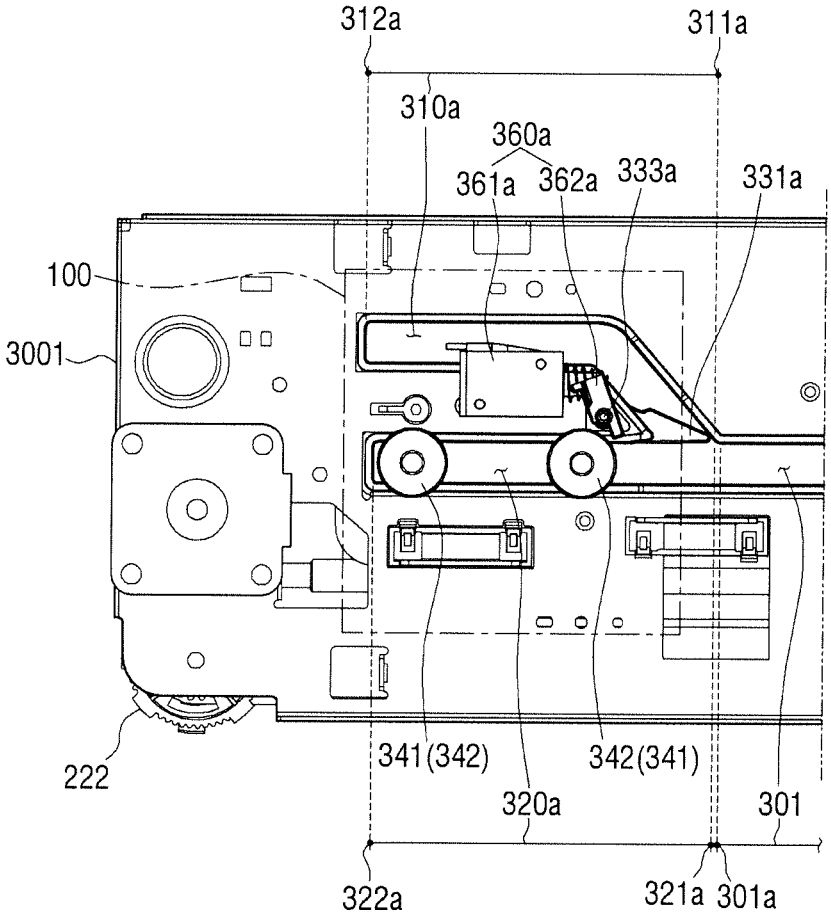
FIGS. 5A and 5B are enlarged views of forms in which first and second rollers illustrated in FIG. 4 move to second branch slots.
Figure 5B:
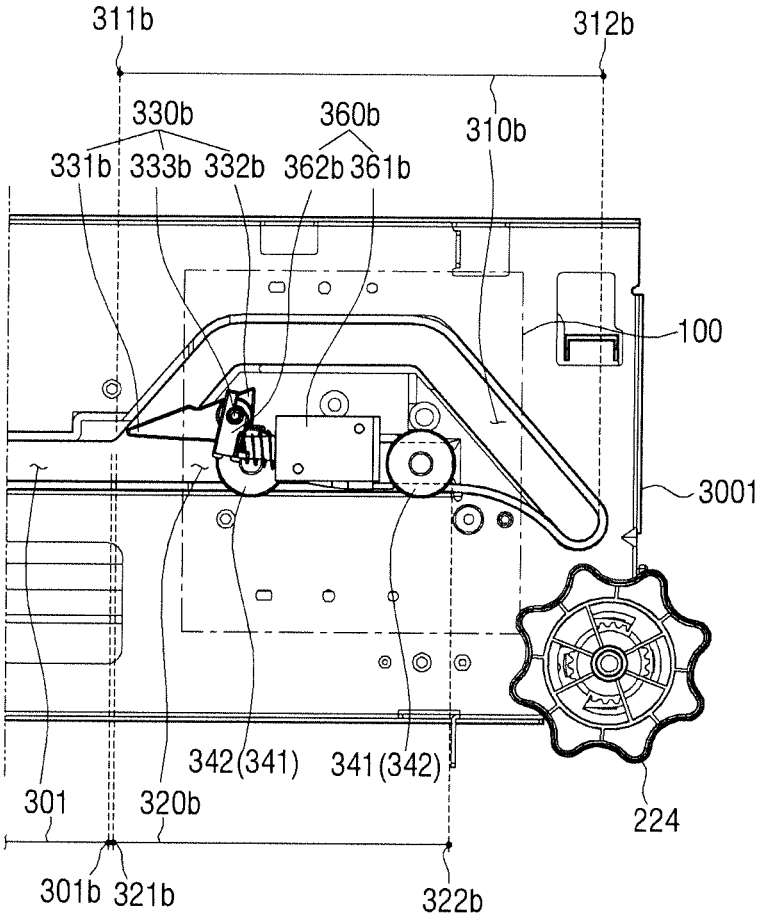

FIGS. 5A and 5B are enlarged views of forms in which first and second rollers 341 and 342 move to second branch slots 320*a* and 320*b*.

FIG. 5A is an enlarged view of first and second branch slots 310*a* and 320*a* branched from one end portion 301*a* of a main slot 301.

As illustrated in FIG. 5A, the switching lever 330*a* may rotate around a shaft 333*a* disposed at the other end portion thereof opposed to one end portion 331*a* thereof so that one end portion 331*a* thereof may selectively open or close the first branch slot 310*a* and the second branch slot 320*a*.

In addition, the rotation driving unit 360*a* may include a solenoid 361*a* and a connection member 362*a*.

One end portion of the connection member 362*a* may be coupled to the shaft 333*a* of the switching lever 330*a*, and the other end portion thereof opposed to one end portion thereof may be coupled to the solenoid 361*a*.

The solenoid 361*a* may push or pull the other end portion of the connection member 362*a* to rotate the switching lever 330*a* around the shaft 333*a*. Therefore, one end portion 331*a* of the switching lever 330*a* may selectively open or close the first branch slot 310*a* or the second branch slot 320*a*.

The solenoid 361*a* may be controlled through the controller to selectively open or close the first branch slot 310*a* and the second branch slot 320*a* through the switching lever 330*a*.

As illustrated in FIG. 5A, the solenoid 361*a* pulls the other end portion of the connection member 362*a*, such that the switching lever 330*a* may rotate in a direction in which it closes the first branch slot 310*a*. Therefore, the second branch slot 320*a* is opened.

In a state in which the second branch slot 320*a* is opened, the first and second rollers 341 and 342 may enter one end portion 321*a* of the second branch slot 320*a* from the main slot 301, and may move in the horizontal direction along the second branch slot 320*a*.

FIG. 5B is an enlarged view of first and second branch slots 310*b* and 320*b* branched from the other end portion 301*b* of a main slot 301.

As illustrated in FIG. 5B, the switching lever 330*b* may rotate around a shaft 333*b* disposed at the other end portion 332*b* thereof opposed to one end portion 331*b* thereof so that one end portion 331*b* thereof may selectively open or close the first branch slot 310*b* and the second branch slot 320*b*. In addition, the rotation driving unit 360*b* may include a solenoid 361*b* and a connection member 362*b*. One end portion of the connection member 362*b* may be coupled to the shaft 333*b* of the switching lever 330*a*, and the other end portion thereof opposed to one end portion thereof may be coupled to the solenoid 361*b*. The solenoid 361*b* may push or pull the other end portion of the connection member 362*b*, such that the switching lever 330*b* may rotate in a direction in which it closes the first branch slot 310*b*. Therefore, the second branch slot 320*b* may be opened, and the first and second rollers 341 and 342 may move in the horizontal direction along the second branch slot 320*b*.

As described above, the switching levers 330*a* and 330*b* each disposed at one end portion 301*a* and the other end portion 301*b* of the main slot 301 close the first branch slots 310*a* and 310*b*, respectively, and open the second branch slots 320*a* and 320*b*, respectively, such that the first and second rollers 341 and 342 may move in the horizontal direction through the second branch slots 320*a* and 320*b* extended from the main slot 301 to the same straight line.

Figure 6A:
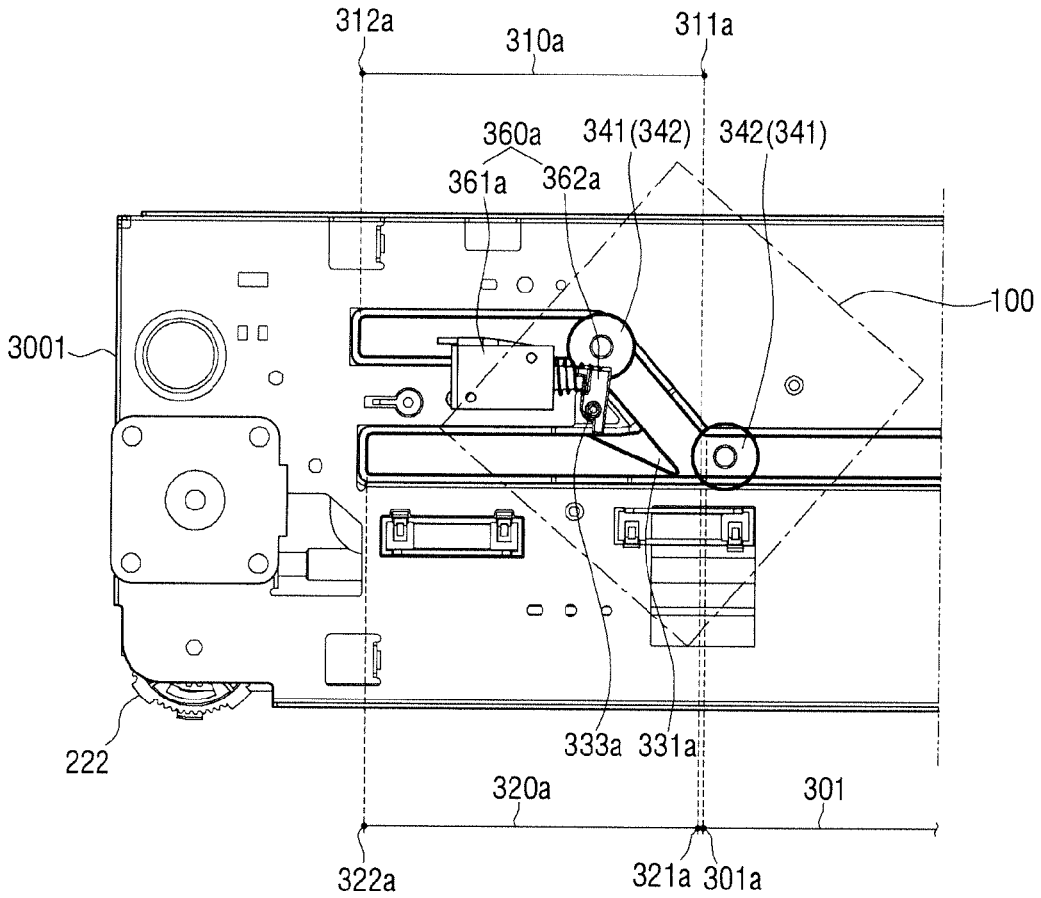
FIGS. 6A and 6B are enlarged views of a form in which the first and second rollers move along a first branch slot branched from one end portion of a main slot.
Figure 6B:
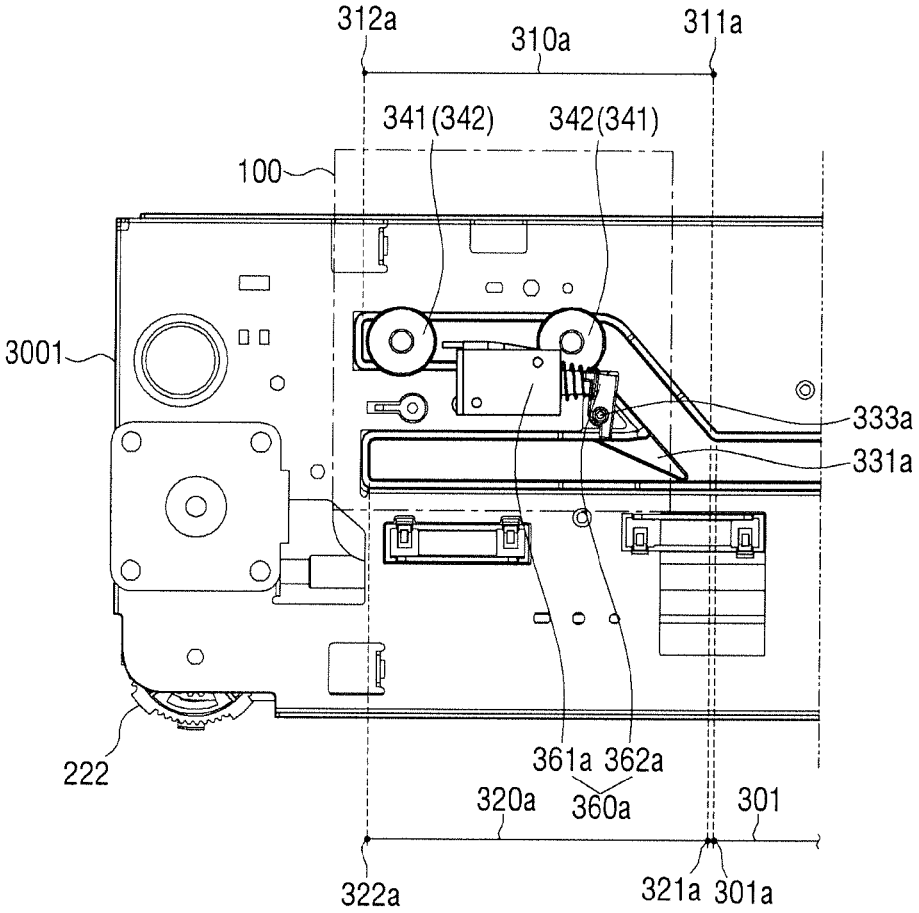

FIGS. 6A and 6B are enlarged views of a form in which the first and second rollers 341 and 342 move along a first branch slot 310*a* branched from one end portion 301*a* of a main slot 301.

As illustrated in FIG. 6A, the solenoid 361*a* pushes the other end portion of the connection member 362*a*, such that the switching lever 330*a* may rotate in the direction in which it closes the second branch slot 320*a*. Therefore, the first branch slot 310*a* is opened.

In a state in which the first branch slot 310*a* is opened, the first and second rollers 341 and 342 may sequentially enter one end portion 311*a* of the first branch slot 310*a*, and may move along the first branch slot 310*a*.

The first and second rollers 341 and 342 are disposed in the inclined section of the first branch slot 310*a*, such that the stapler 100 may rotate. Therefore, the stapler 100 may staple the printing medium in an inclined direction.

In addition, the first and second rollers 341 and 342 may pass through the bent section of the first branch slot 310*a* and then move along a horizontal section parallel with the second branch slot 320*a*, and as illustrated in FIG. 6B, the first and second rollers 341 and 342 may move until the first roller 341 is in contact with the other end portion 312*a* of the first branch slot 310*a*.

Figure 7A:
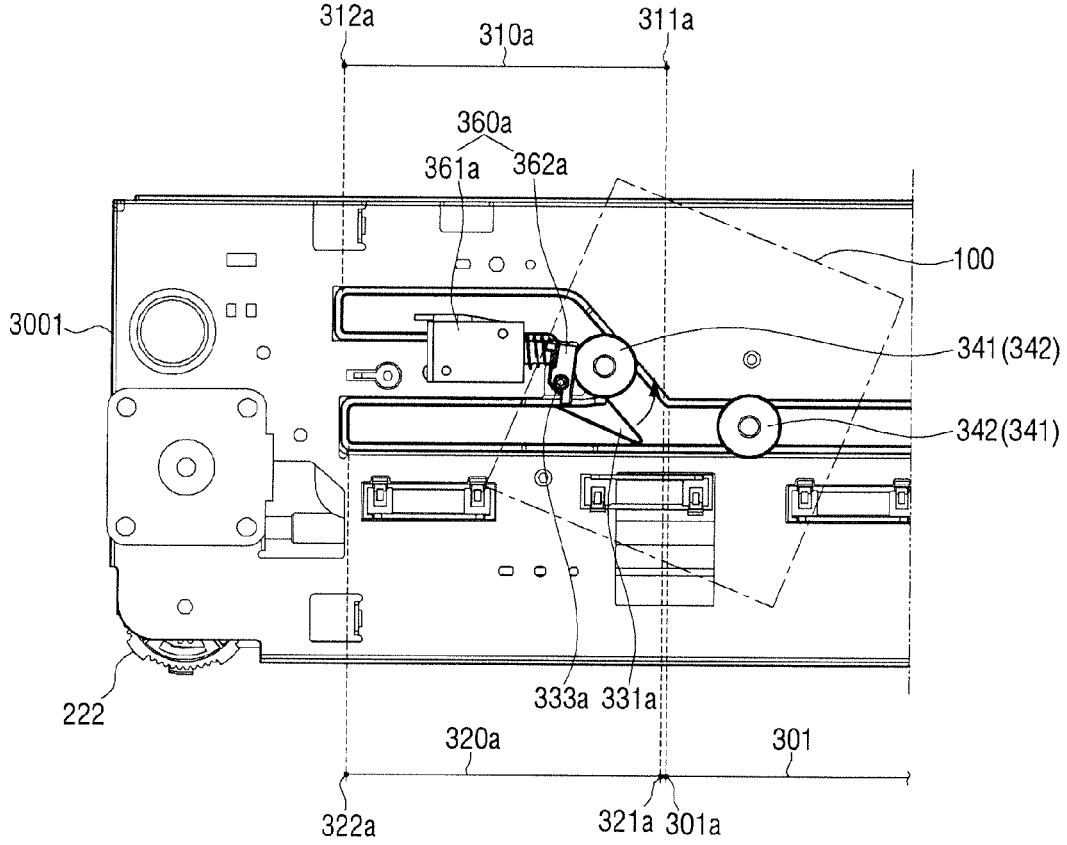
FIGS. 7A to 7C are enlarged views of a form in which the first and second rollers move, respectively, along the first and second branch slots branched from one end portion of the main slot.
Figure 7B:
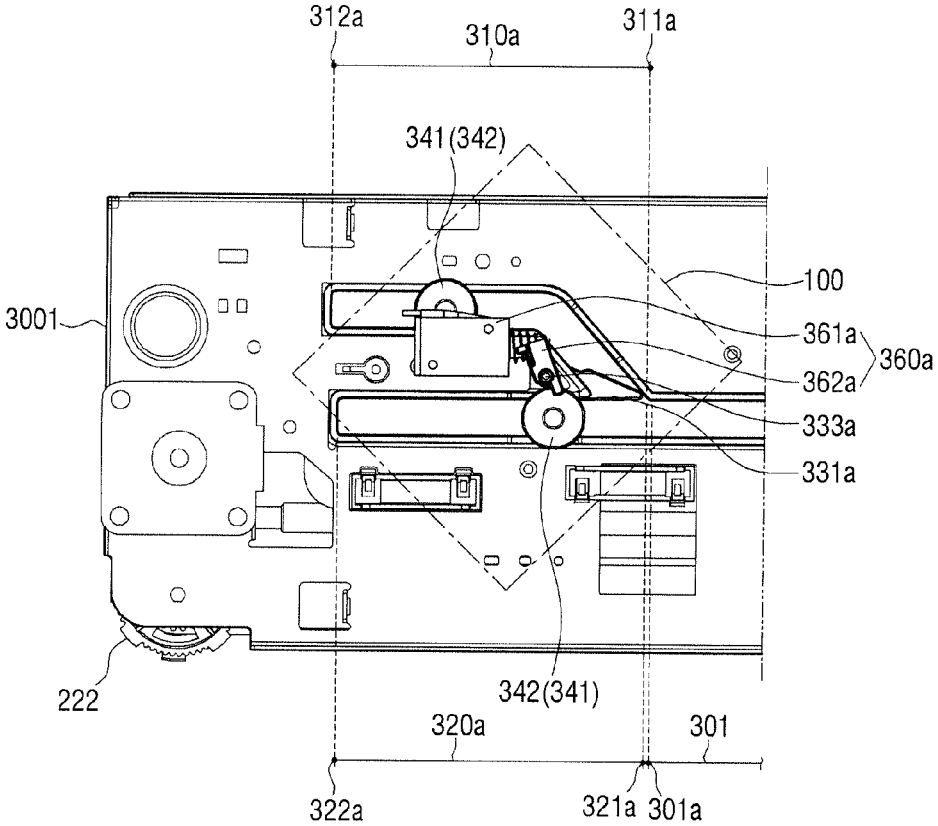
Figure 7C:
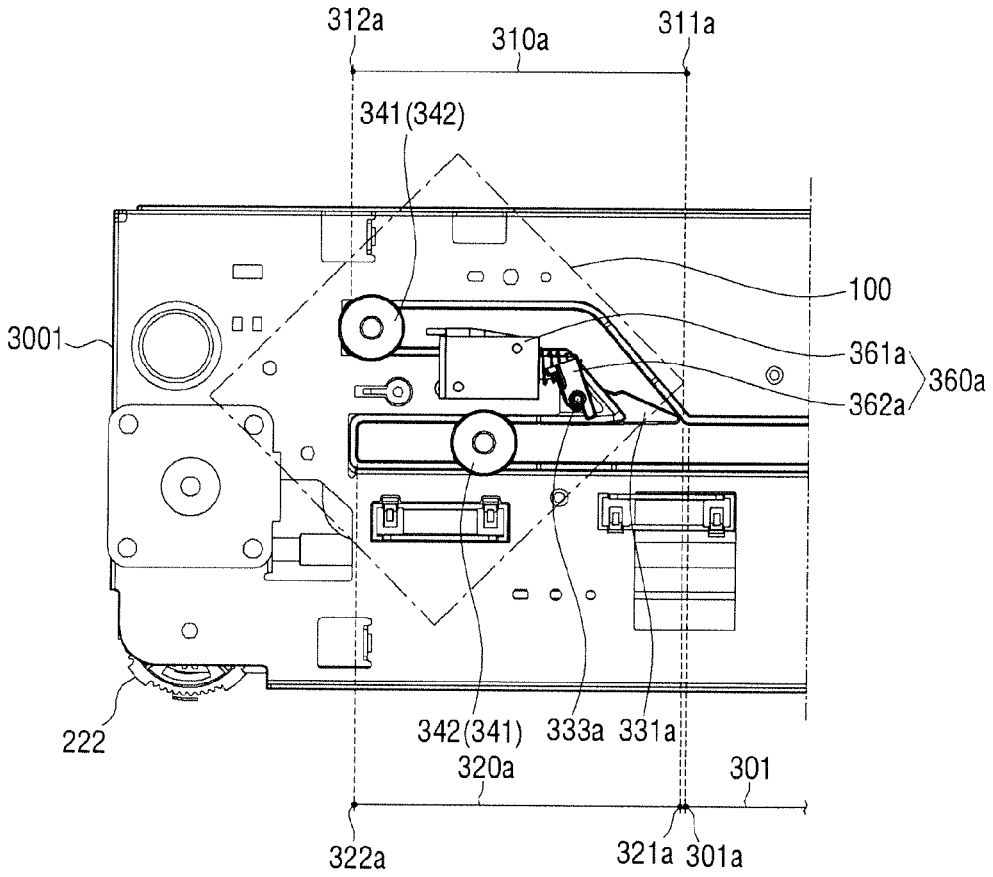

FIGS. 7A to 7C are views illustrating a form in which the first roller 341 moves along the first branch slot 310*a* branched from one end portion 301*a* of the main slot 301 and the second roller 342 moves along the second branch slot 320*a* branched from one end portion 301*a* of the main slot 301.

As illustrated in FIG. 7A, when the first roller 341 enters the first branch slot 310*a* through one end portion 311*a* of the first branch slot 310*a* in a state in which the switching lever 330*a* closes the second branch slot 320*a*, the solenoid 361*a* pulls the other end portion of the connection member 362*a*, such that the switching lever 330*a* may rotate in a direction in which it closes the first branch slot 310*a*.

When the switching lever 330*a* rotates to close the first branch slot 310*a* and open the second branch slot 320*a*, the second roller 342 following the first roller 341 may enter one end portion 321*a* of the second branch slot 320*a*, as illustrated in FIG. 7B.

As described above, immediately after the first roller 341 enters the first branch slot 310*a*, the switching lever 330*a* rotates to close the first branch slot 310*a* and open the second branch slot 320*a*, such that the first and second rollers 341 and 342 may enter the first and second branch slots 310*a* and 320*a*, respectively.

Therefore, as illustrated in FIGS. 7B and 7C, the first roller 341 moves along the first branch slot 310*a*, and the second roller 342 moves along the second branch slot 320*a*, such that the stapler 100 may move in an inclined state in the horizontal direction.

Figure 8A:
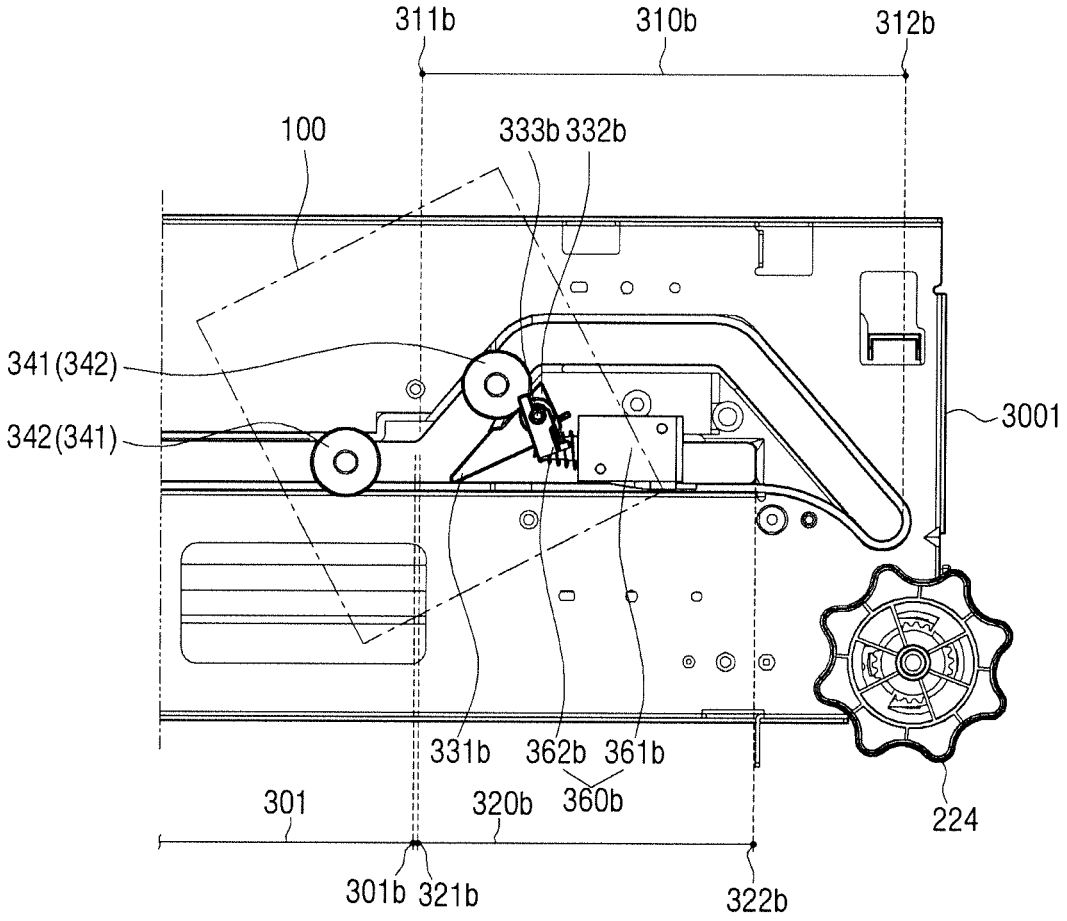
FIGS. 8A to 8C are enlarged views of a form in which the first and second rollers move along the first branch slot branched from the other end portion of the main slot.
Figure 8B:
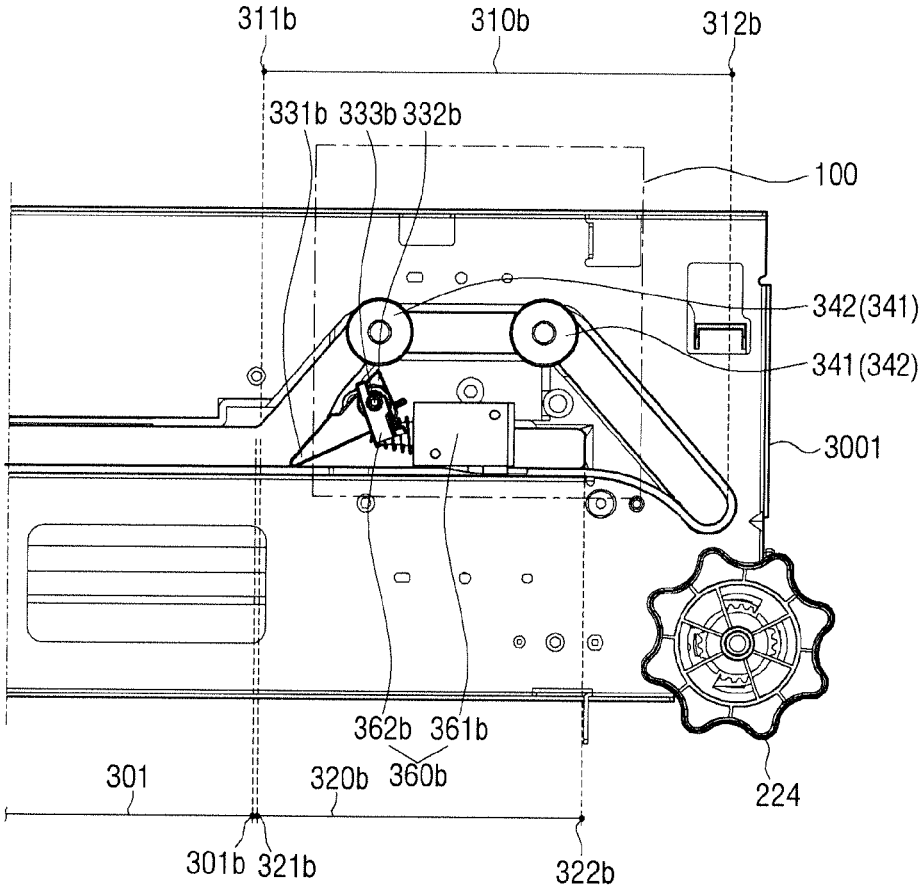
Figure 8C:
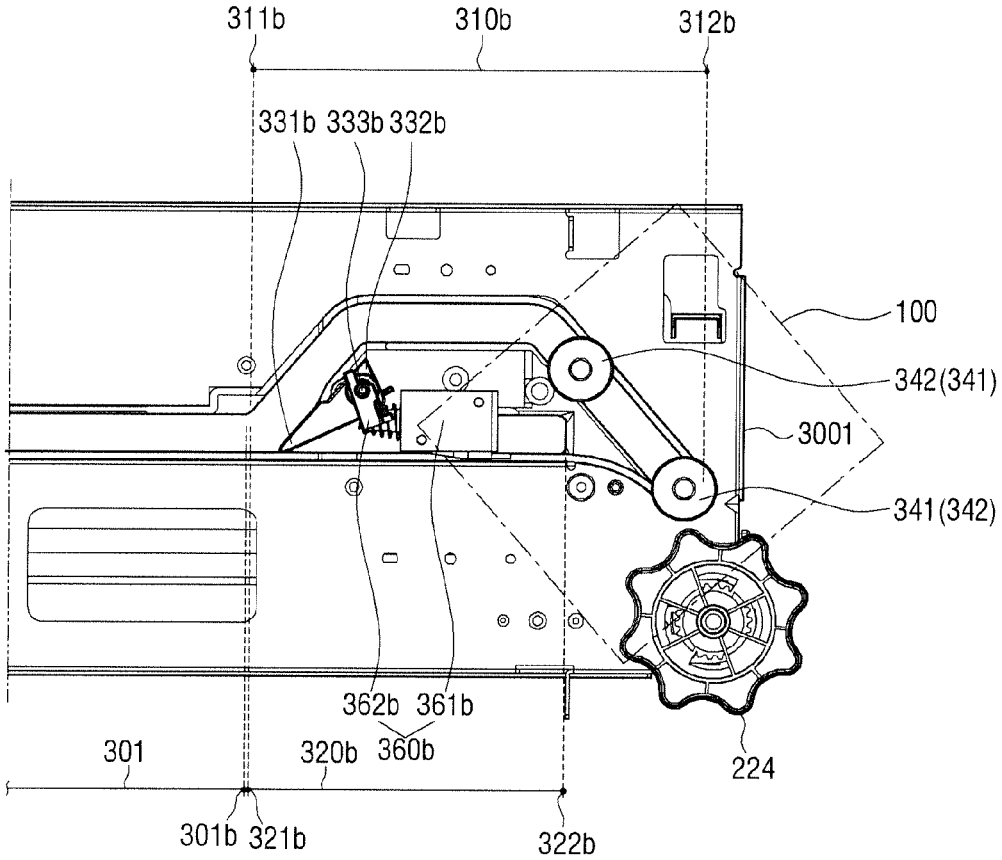

FIGS. 8A to 8C are enlarged views of a form in which the first and second rollers 341 and 342 move along the first branch slot 310*b* branched from the other end portion 301*b* of the main slot 301.

As illustrated in FIG. 8A, in a state in which the first branch slot 310*b* is opened, the first and second rollers 341 and 342 may sequentially enter one end portion 311*b* of the first branch slot 310*b*, and may move along the first branch slot 310*b*.

As illustrated in FIG. 8A, the first and second rollers 341 and 342 enter the inclined section of the first branch slot 310*b*, such that the stapler 100 may rotate.

In addition, as illustrated in FIG. 8B, the first and second rollers 341 and 342 may pass through the inclined section and the bent section and then move along a section parallel with the second branch slot 320*b*.

In addition, as illustrated in FIG. 8C, the first and second rollers 341 and 342 may additionally pass through the bent section and then move up to the other end portion 312*b* of the first branch slot 310*b*. Therefore, the stapler 100 may rotate in various directions and at various angles.

In addition, a path of the first branch slot 310*b* may be modified into various paths, in addition to the path illustrated in FIGS. 8A to 8C. Therefore, a moving path and an angle of the stapler 100 may also be variously modified.

Figure 9A:
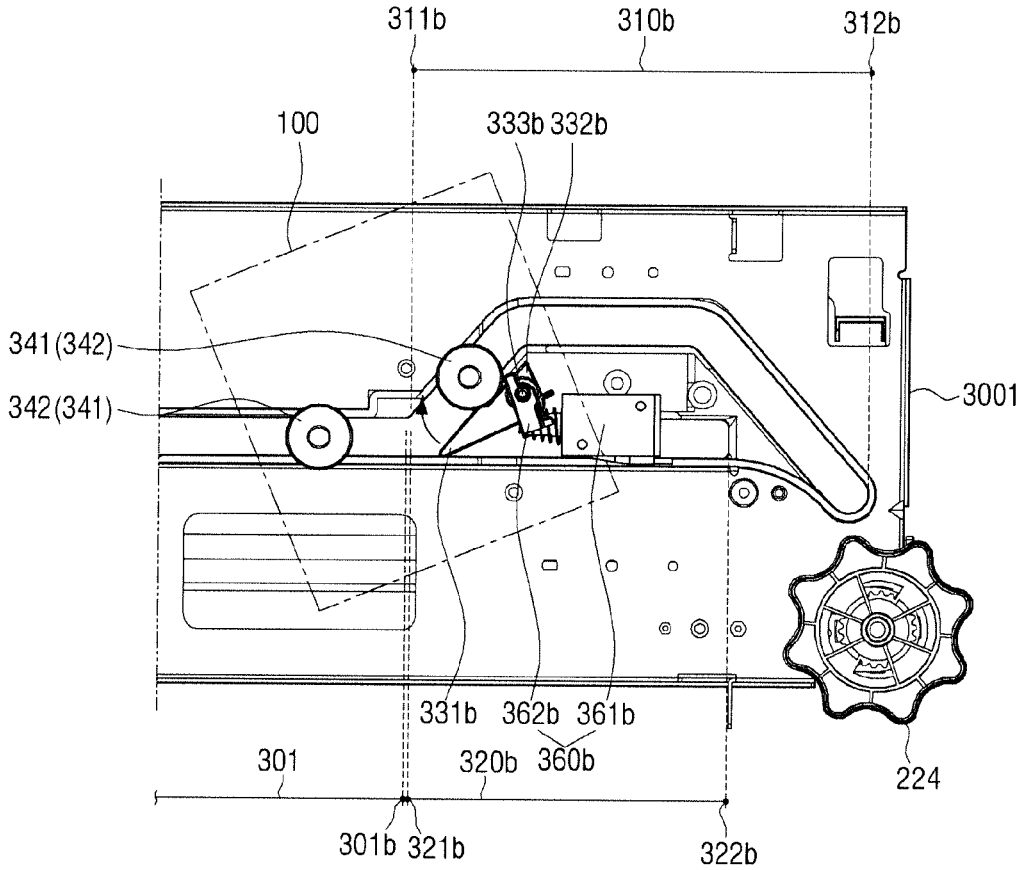
FIGS. 9A to 9C are enlarged views of a form in which the first and second rollers move, respectively, along the first and second branch slots branched from the other end portion of the main slot.
Figure 9B:
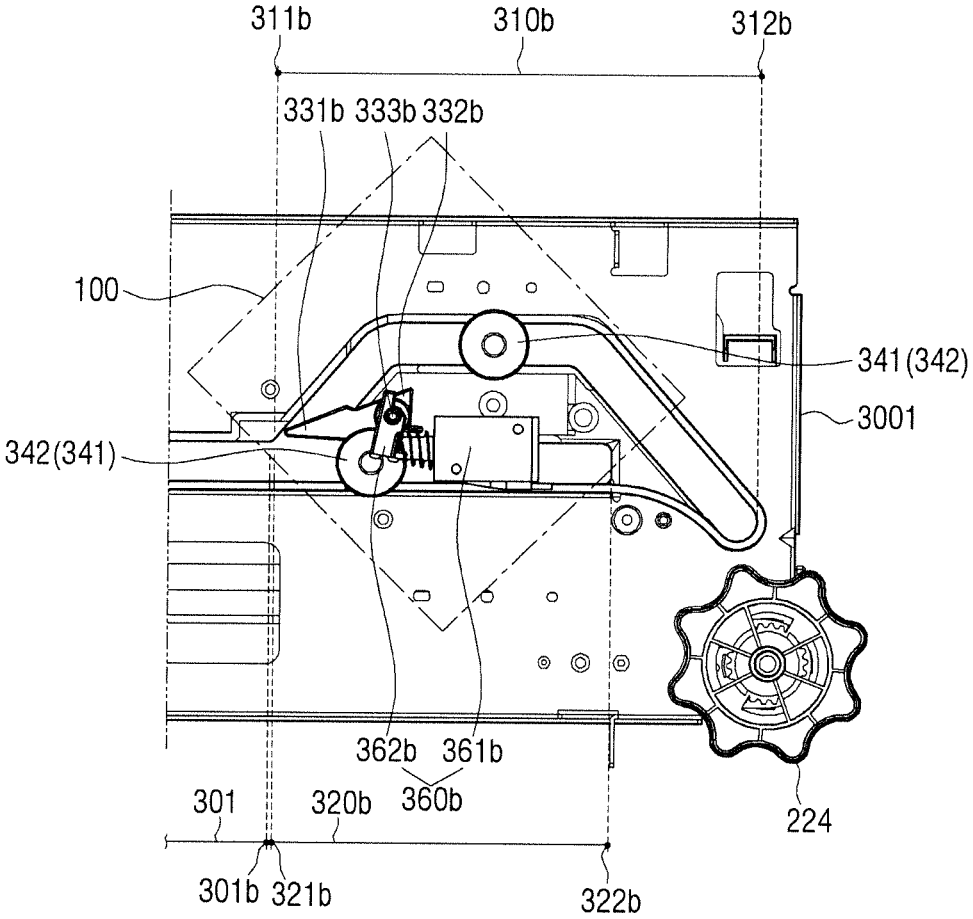
Figure 9C:
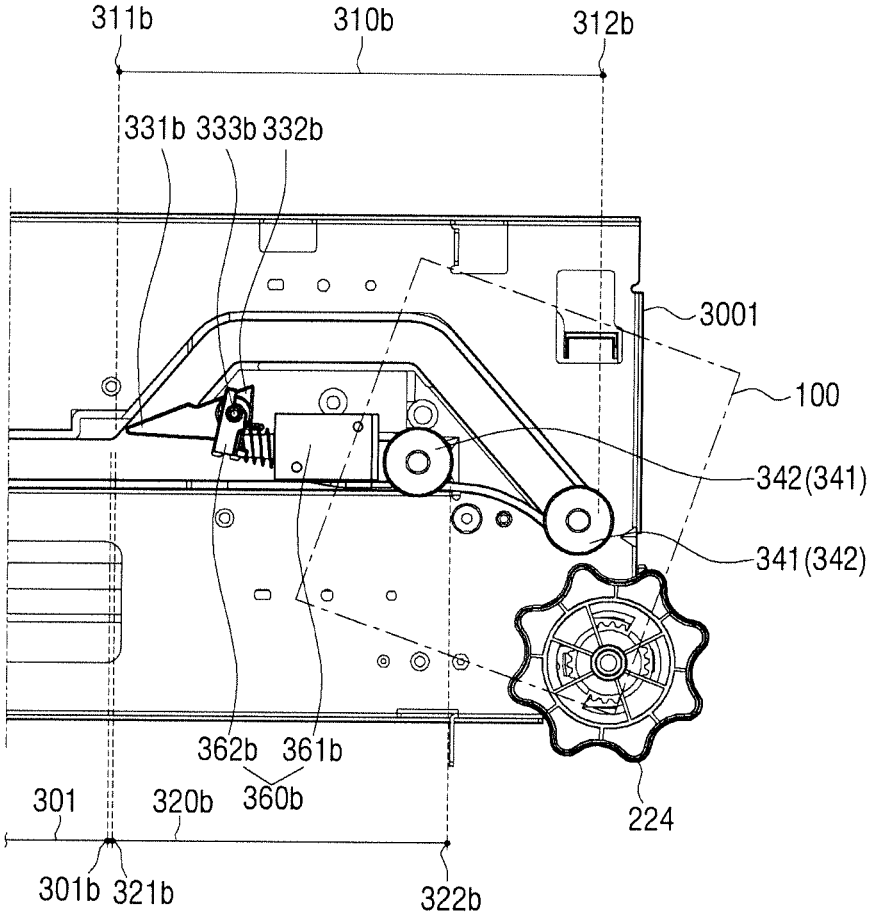

FIGS. 9A to 9C are views illustrating a form in which the first roller 341 moves along the first branch slot 310*b* branched from the other end portion 301*b* of the main slot 301 and the second roller 342 moves along the second branch slot 320*b* branched from the other end portion 301*b* of the main slot 301.

As illustrated in FIG. 9A, when the first roller 341 enters the first branch slot 310*b* through one end portion 311*b* of the first branch slot 310*b* in a state in which the switching lever 330*b* closes the second branch slot 320*b*, the solenoid 361*b* pushes the other end portion of the connection member 362*b*, such that the switching lever 330*b* may rotate in a direction in which it closes the first branch slot 310*b*.

Therefore, as illustrated in FIG. 9B, the second roller 342 following the first roller 341 may enter one end portion 321*b* of the second branch slot 320*a*.

As described above, immediately after the first roller 341 enters the first branch slot 310*b*, the switching lever 330*b* rotates to close the first branch slot 310*b* and open the second branch slot 320*b*, such that the first and second rollers 341 and 342 may enter the first and second branch slots 310*b* and 320*b*, respectively.

As described above, the first branch slot 310*b* may include the plurality of bent sections, such that a path of the first branch slot 310*b* may be variously bent. Therefore, as illustrated in FIGS. 9B and 9C, the first roller 341 moves along the first branch slot 310*b*, and the second roller 342 moves along the second branch slot 320*b*, such that the stapler 100 may move while being deformed at various angles in an inclined state.

Figure 10:
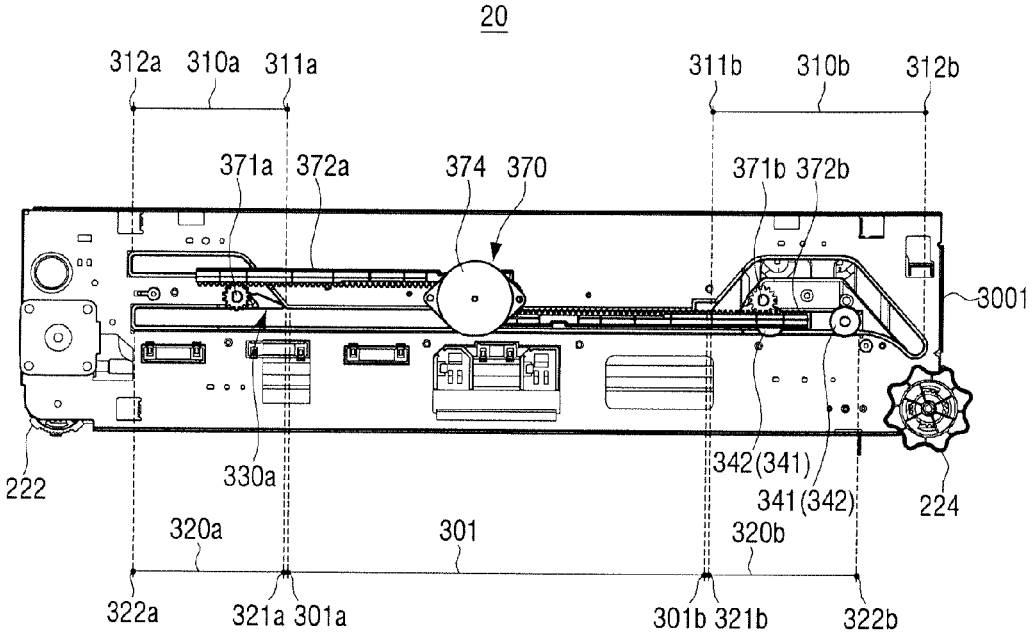
FIG. 10 is a bottom view of a stapling apparatus according to another exemplary embodiment of the disclosure.
Figure 11:
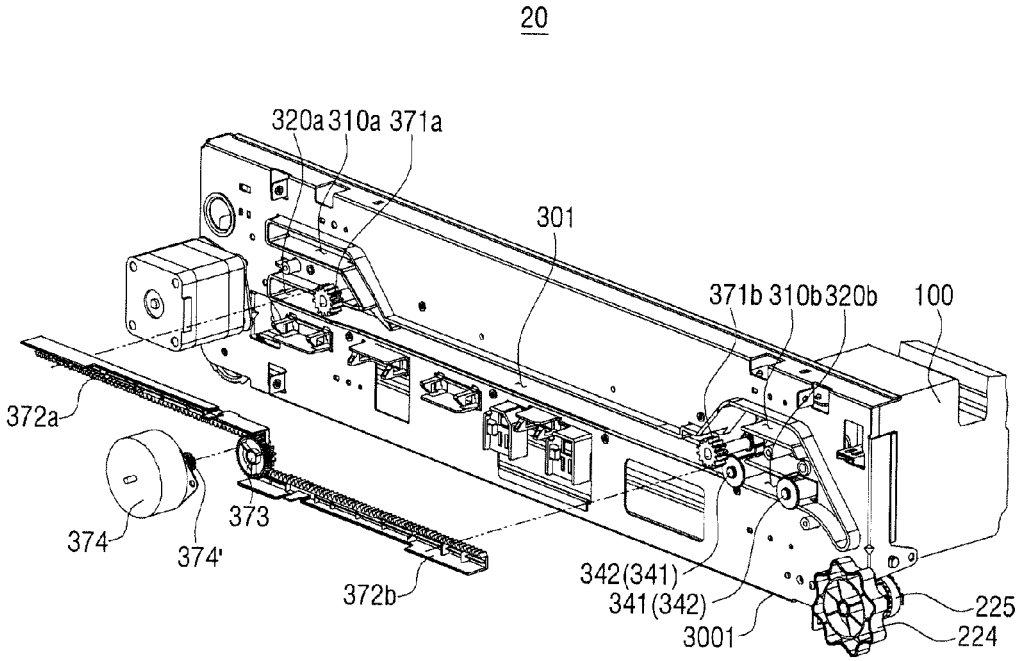
FIG. 11 is an exploded perspective view of a rotation driving unit of the stapling apparatus illustrated in FIG. 10.

FIG. 10 is a bottom view of a stapling apparatus 20 according to another exemplary embodiment of the disclosure, and FIG. 11 is an exploded perspective view of a rotation driving unit 370 of the stapling apparatus 20 illustrated in FIG. 10.

The stapling apparatus 20 illustrated in FIGS. 10 and 11 may include a stapler 100, a driver 200, and a guide part 300.

Components of the stapling apparatus 20 according to another exemplary embodiment of the disclosure except for a rotation driving unit 370 are the same as those of the stapling apparatus 10 according to an exemplary embodiment of the disclosure.

Therefore, in describing a structure of the stapling apparatus 20 according to another exemplary embodiment of the disclosure, a description overlapped with that for the stapling apparatus 10 according to an exemplary embodiment of the disclosure will be omitted, and a structure of the rotation driving unit 370 will be mainly described hereinafter.

A guide plate 3001 may further include first branch slots 310*a* and 310*b* and second branch slots 320*a* and 320*b* branched from one end portion 301*a* and the other end portion 301*b* of a main slot 301.

In addition, switching levers 330*a* and 330*b* selectively opening or closing the first branch slots 310*a* and 310*b* and the second branch slots 320*a* and 320*b*, respectively, may be disposed between the first branch slots 310*a* and 310*b* and the second branch slots 320*a* and 320*b*, respectively.

Hereinafter, for convenience of explanation, the first branch slot 310*b* branched from the other end portion 301*b* of the main slot 301 will be referred to as a third branch slot 310*b*, and the second branch slot 320*b* branched from the other end portion 301*b* of the main slot 301 will be referred to as a fourth branch slot 320*b*.

In addition, the switching lever 330*a* disposed between the first branch slot 310*a* and the second branch slot 320*a* branched from one end portion 301*a* of the main slot 301 will be referred to as a first switching lever 330*a*, and the switching lever 330*b* disposed between the third branch slot 310*b* and the fourth branch slot 320*b* will be referred to as a second switching lever 330*b*.

The rotation driving unit 370 according to another exemplary embodiment of the disclosure may simultaneously rotate the first and second switching levers 330*a* and 330*b* through one motor 374.

In detail, the rotation driving unit 370 may include a first pinion gear 371*a* coupled to a shaft 333*a* of the first switching lever 330*a*, a first rack gear 372*a* having one end portion engaged with the first pinion gear 371*a*, a second pinion gear 371*b* coupled to the shaft 333*b* of the second switching lever 330*b*, a second rack gear 372*b* having one end portion engaged with the second pinion gear 371*b*, a driving pinion gear 373 simultaneously engaged with the other end portion of the first rack gear 372*a* and the other end portion of the second rack gear 372*b*, and a motor 374, and the motor 374 may further include a driving gear 374' engaged with the driving pinion gear 373.

The driving gear 374' coupled to the motor 374 rotates, such that the driving pinion gear 373 may rotate, and the first and second rack gears 372*a* and 372*b* may simultaneously rotate the first and second pinion gears 371*a* and 371*b*, respectively, while simultaneously moving by the rotation of the driving pinion gear 373.

Therefore, the first and second pinion gears 371*a* and 371*b* simultaneously rotate, such that the first and second switching levers 330*a* and 330*b* may simultaneously rotate.

As described above, since the rotation driving unit 370 of the stapling apparatus 20 according to another exemplary embodiment of the disclosure may simultaneously rotate a plurality of switching levers 330*a* and 330*b* through one motor 374, a structure of the stapling apparatus 20 may be further simplified.

In addition, even though a switching lever is additionally disposed in addition to the first and second switching levers 330*a* and 330*b*, a pinion gear engaged with the first and second rack gears 372*a* and 372*b* is added, and is coupled to a shaft of the additionally disposed switching lever, such that a plurality of branch slots may be selectively opened or closed by a single motor also in a stapling apparatus including a plurality of switching levers.

Figure 12:
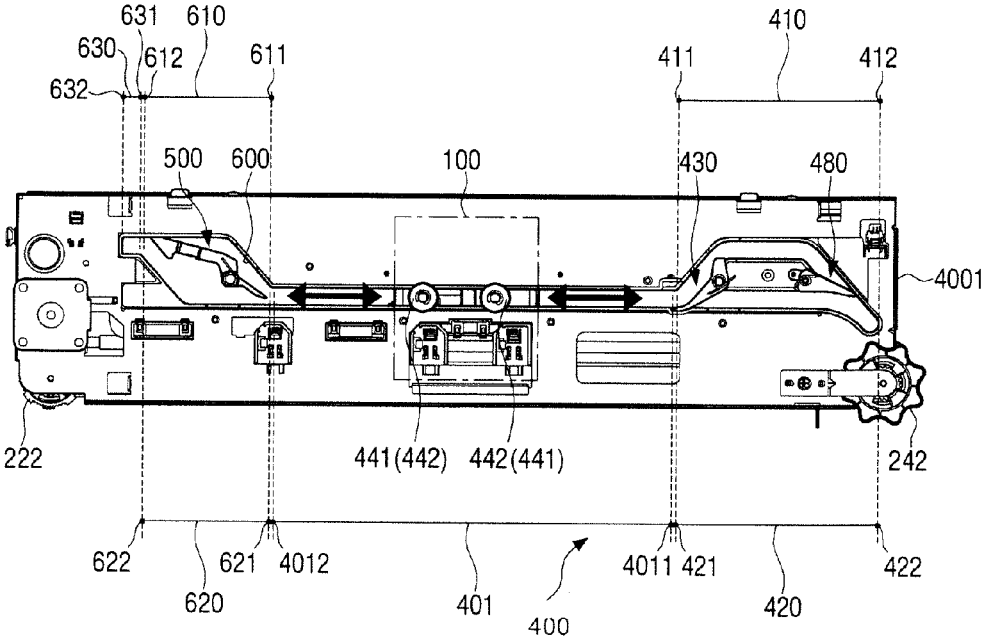
FIG. 12 is a bottom view of a stapling apparatus according to still another exemplary embodiment of the disclosure.

FIG. 12 is a bottom view of a stapling apparatus 30 according to still another exemplary embodiment of the disclosure.

The stapling apparatus 30 according to still another exemplary embodiment of the disclosure may include a stapler 100, a driver 200, and a guide part 400.

Since the stapler 100 and the driver 200 are the same as those of the stapling apparatus 10 illustrated in FIG. 4, an overlapped description will be omitted.

The guide part 400 may include a guide plate 4001, and a slot guiding movement of the stapler 100 is formed in the guide plate 4001.

As illustrated in FIG. 12, a main slot 401 extended in a horizontal direction may be disposed at the center of the guide plate 4001, and first and second branch slots 410 and 420 branched from the main slot 401 may be formed at one end portion 4011 of the main slot 401.

The first and second branch slots 410 and 420 may be branched from one end portion 4011 of the main slot 401 at various angles and in various directions.

For example, as illustrated in FIG. 12, the first branch slot 410 may be branched in an inclined form from one end portion 4011 of the main slot 401, and the second branch slot 420 may be formed on the same straight line as that of the main slot 401 to extend the main slot 401 in the horizontal direction.

A first switching lever 430 may be disposed between the first branch slot 410 and the second branch slot 420, and may selectively open or close the first branch slot 410 and the second branch slot 420.

In addition, the first switching lever 430 may further include a first elastic member 434 (see FIG. 13*a*) applying force to the first switching lever 430 so that the first switching lever 430 rotates in a first direction in which it closes the second branch slot 420.

Therefore, as illustrated in FIG. 12, the first switching lever 430 may maintain a state in which it closes the second branch slot 420 by the first elastic member 434.

In addition, the other end portion 412 of the first branch slot 410 and the other end portion 422 of the second branch slot 420 may be connected to each other so that the first branch slot 410 and the second branch slot 420 form a closed loop.

In addition, a blocking lever 480 opening or closing the other end portion 412 of the first branch slot 410 may be further included between the other end portion 412 of the first branch slot 410 and the other end portion 422 of the second branch slot 420. The blocking lever 480 may block a first roller 441 from entering the first branch slot 410 from the second branch slot 420. A configuration of the blocking lever 480 will be described below.

FIGS. 13A to 13D are enlarged views of a form in which first and second rollers 441 and 442 move along first and second branch slots 410 and 420.

Figure 13A:
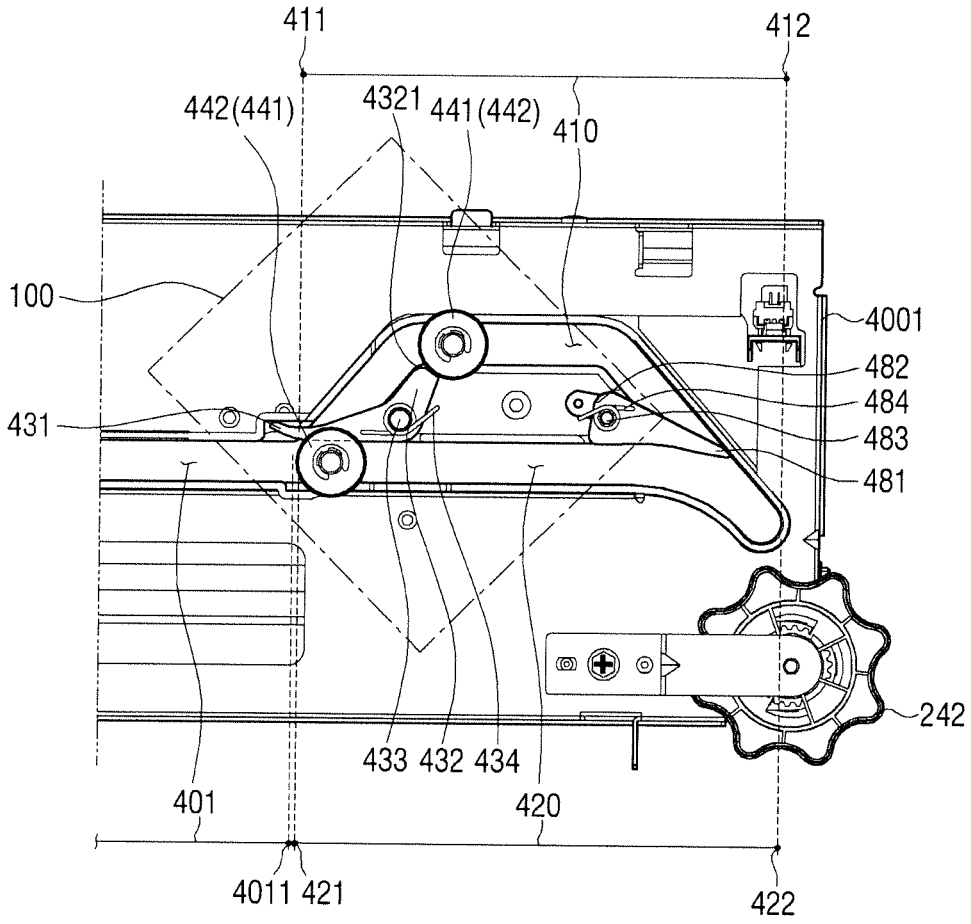
FIGS. 13A to 13D are enlarged views of a form in which first and second rollers illustrated in FIG. 12 move along first and second branch slots.

Referring to FIG. 13A, the first switching lever 430 may rotate around a shaft 433 disposed at the other end portion 432 thereof opposed to one end portion 431 thereof so that one end portion 431 thereof may selectively open or close the first branch slot 410 and the second branch slot 420.

In addition, the first elastic member 434 may be coupled to the shaft 433 of the first switching lever 430 to apply the force to the first switching lever 430 so that the first switching lever 430 rotates in the first direction in which it closes the second branch slot 420.

The first switching lever 430 may further include a protrusion part 4321 protruding from the other end portion 432 of the first switching lever 430 toward an inner side of the first branch slot 410.

The protrusion part 4321 may be subjected to interference by the first roller 441 passing through the first branch slot 410, and may be pressed by the first roller 441.

In detail, the first switching lever 430 may receive the force applied from the first elastic member 434 to maintain a state in which the first branch slot 410 is opened, and the first roller 441 may enter one end portion 411 of the first branch slot 410.

The first roller 441 moving along the first branch slot 410 passes through the first branch slot 410 while pressing the protrusion part 4321 of the first switching lever 430, and the first roller 441 presses the protrusion part 4321, such that the first switching lever 430 may rotate in a second direction in which it closes the first branch slot 410.

To this end, it is preferable that force at which the first roller 441 presses the protrusion part 4321 is greater than force at which the first elastic member 434 rotates the first switching lever 430 in the first direction in which the first switching lever 430 closes the second branch slot 420.

As illustrated in FIG. 13A, when the first switching lever 430 rotates in the second direction by the first roller 441 pressing the protrusion part 4321, the second roller 442 following the first roller 441 may enter one end portion 421 of the opened second branch slot 420.

As described above, as the first roller 441 presses the protrusion part 4321 while moving along the first branch slot 410, the first switching lever 430 rotates in the second direction in which it opens the second branch slot 420, such that the first and second rollers 441 and 442 may enter the first and second branch slots 410 and 420, respectively.

Figure 13B:
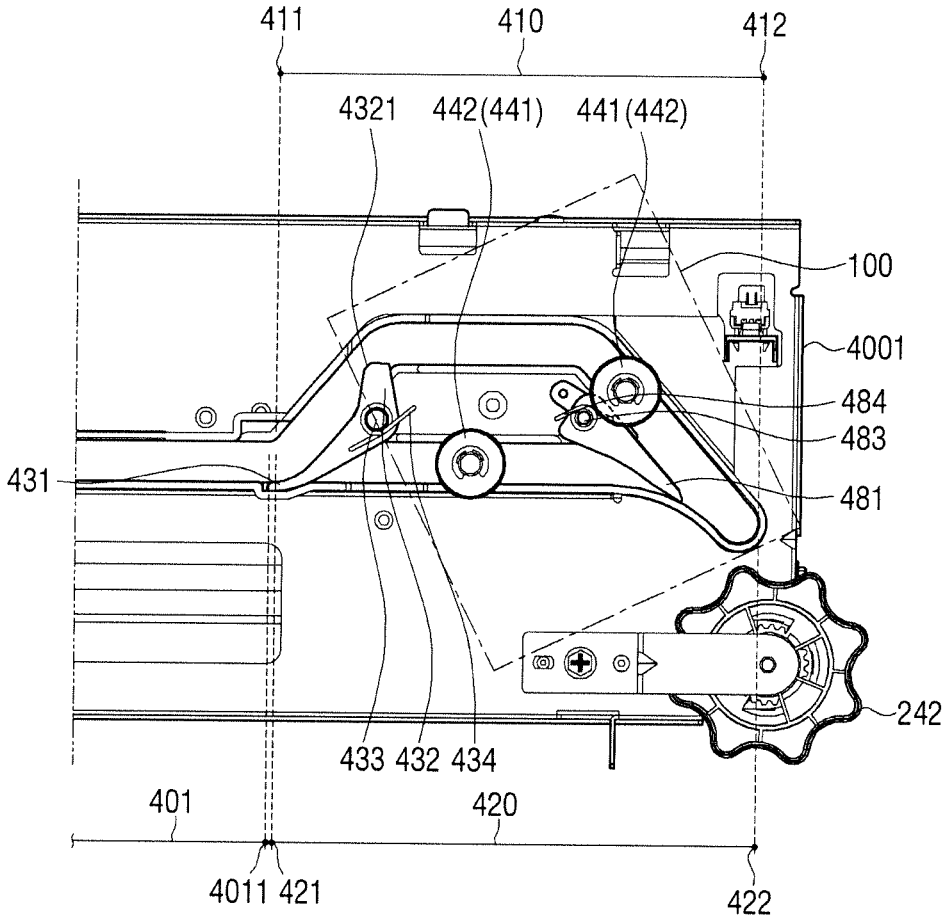

Referring to FIG. 13B, as described above, since the first roller 441 passes through the first branch slot 410 while pressing the protrusion part 4321, as soon as the protrusion part 4321 is released from being pressed from the first roller 441, the first switching lever 430 again rotates in the first direction in which it closes the second branch slot 420 due to the first elastic member 434.

Again referring to FIG. 13A, the blocking lever 480 may rotate around a shaft 483 disposed at the other end portion 482 thereof so that one end portion 481 thereof opens or closes the other end portion 412 of the first branch slot 410.

In addition, a blocking elastic member 484 may be coupled to the shaft 483 of the blocking lever 480 to apply force the blocking lever 480 so that the blocking lever 480 rotates in a third direction in which the blocking lever 480 closes the other end portion 412 of the first branch slot 410.

Therefore, the blocking lever 480 may maintain a state in which it closes the other end portion 412 of the first branch slot 410 due to the blocking elastic member 484, as illustrated in FIG. 13A.

In addition, the blocking lever 480 may be supported by an inner sidewall of the first branch slot 410 in a state in which one end portion 481 thereof closes the other end portion 412 of the first branch slot 410.

As illustrated in FIG. 13B, the first roller 441 moving along the first branch slot 410 may press one end portion 481 of the blocking lever 480.

As described above, one end portion 481 of the blocking lever 480 is pressed by the first roller 441, such that the blocking lever 480 may rotate in a fourth direction in which it opens the other end portion 412 of the first branch slot 410 and the first roller 441 may pass through the opened other end portion 412 of the first branch slot 410 and then enter the other end portion 422 of the second branch slot 420.

Figure 13C:
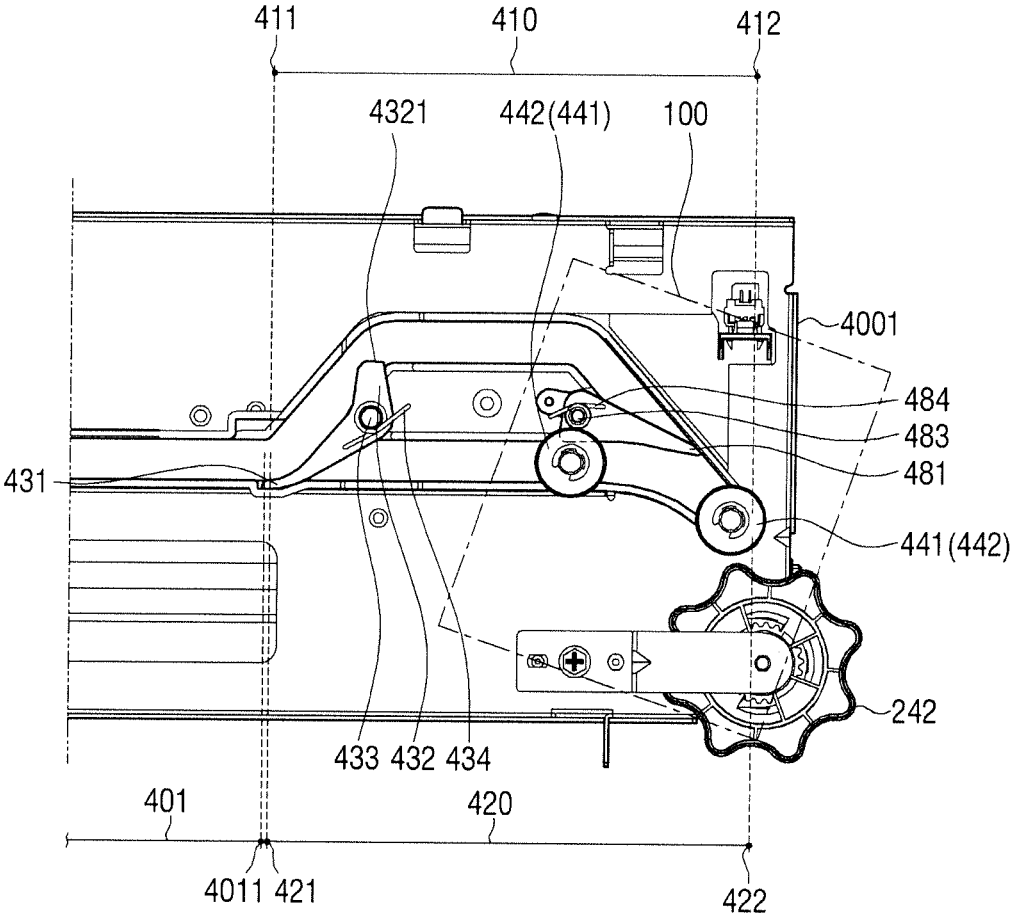

Referring to FIG. 13C, since the first roller 441 passes through the other end portion 412 of the first branch slot 410 while pressing the blocking lever 480, as soon as the blocking lever 480 is released from being pressed from the first roller 441, the blocking lever 480 again rotates in the third direction in which it closes the other end portion 412 of the first branch slot 410 due to the blocking elastic member 484.

The first roller 441 entering the other end portion 422 of the second branch slot 420 may move together with the second roller 442 along the second branch slot 420. In this case, the first roller 441 follows the second roller 442.

Figure 13D:
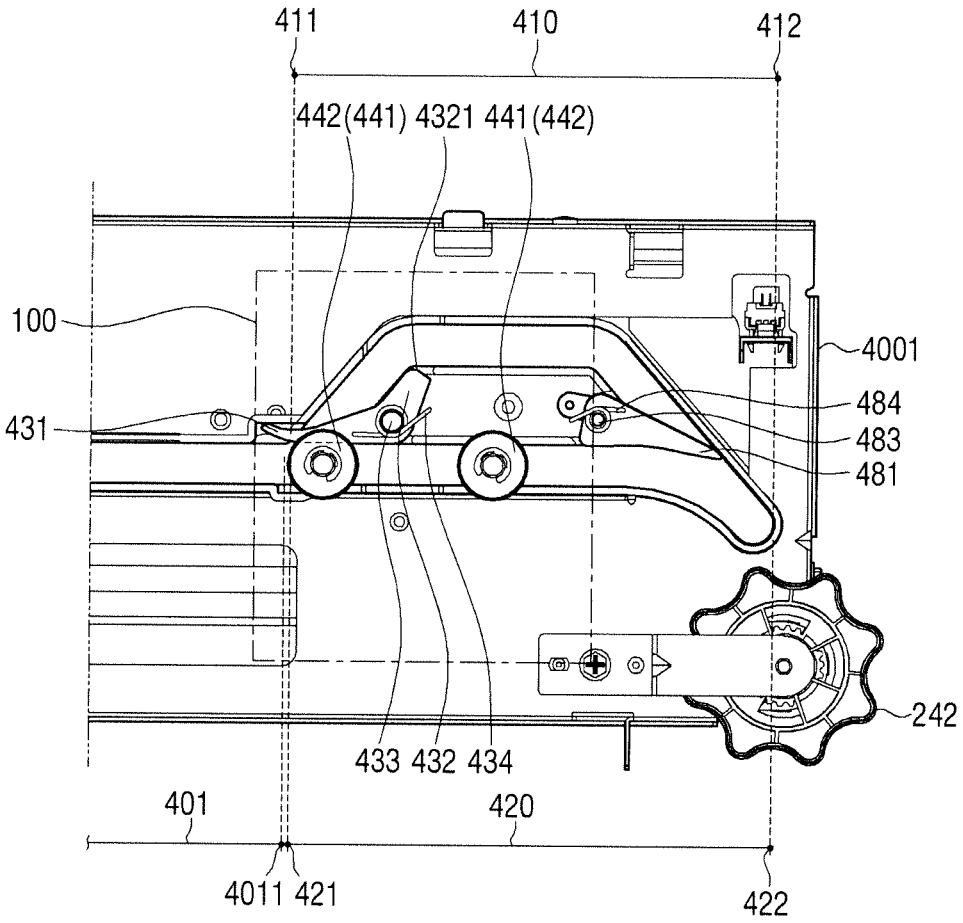

In the first and second roller 441 and 442 moving toward the main slot 401 along the second branch slot 420, as illustrated in FIG. 13D, the second roller 442 may press one end portion 431 of the first switching lever 430 to open one end portion 421 of the second branch slot 420, enter the main slot 401 through one end portion 4011 of the main slot 401, and move along the main slot 401.

Therefore, the first roller 441 may sequentially move along the main slot 401, the first branch slot 410, the second branch slot 420, and the main slot 401. In detail, the first roller 441 may enter the one end portion 411 of the first branch slot 410 from one end portion 4011 of the main slot 401, move along the first branch slot 410, press the blocking lever 480 to enter the other end portion 422 of the second branch slot 420 and move along the second branch slot 420, and again enter one end portion 4011 of the main slot 401 through one end portion 421 of the second branch slot 420.

As described above, the first switching lever 410 according to still another exemplary embodiment of the disclosure may allow the first roller 441 and the second roller 442 to enter the first and second branch slots 410 and 420, respectively, through the first elastic member 434 and the protrusion part 4321 without using a separate driving source. Therefore, the stapler 100 may move while rotating at various angles.

In addition, the first roller 441 entering the second branch slot 420 by pressing the blocking lever 480 moves together with the second roller 442 along the second branch slot 420, such that it may move in the horizontal direction extended from the main slot 401.

Again referring to FIG. 12, an extension slot 600 extended from the other end portion 4012 of the main slot 401 is formed at the other end portion 4012 of the main slot 401 opposed to one end portion 4011 of the main slot 401.

A second switching lever 500 may be rotatably disposed in the extension slot 600.

The second switching lever 500 may have opposite end portions in selective contact with inner sidewalls of the extension slot 600 to partition the extension slot 600 into a first branch slot 610 and a second branch slot 620, and may rotate around a shaft 530 disposed at the center thereof.

Since the second switching lever 500 partitioning the extension slot 600 into the first and second branch slots 610 and 620 rotates in the extension slot 600, shapes of spaces occupied by the first and second branch slots 610 and 620 may be changed depending on rotation of the second switching lever 500.

FIGS. 14A to 14D are enlarged views of a form in which the first and second rollers 441 and 442 move along the first and second branch slots 610 and 620 partitioned through a second switching lever 500.

The extension slot 600 may include first to sixth inner sidewalls 601 to 606 sequentially connected to each other, the first inner sidewall 601 is connected to one sidewall of the other end portion 4012 of the main slot 401, the second inner sidewall 602 is connected to the first inner sidewall 601 in a state in which it is bent at a predetermined angle, the third inner sidewall 603 is connected to the second inner sidewall 602 in a state in which it is bent, the fourth inner sidewall 604 is connected to the third inner sidewall 603 in a state in which it is bent, the fifth inner sidewall 605 is connected to the fourth inner sidewall 604 in a state in which it is bent, and the sixth inner sidewall 606 is connected to the fifth inner sidewall 605 in a state in which it is bent.

In addition, the sixth inner sidewall 606 is connected to the other sidewall facing one sidewall of the other end portion 4012 of the main slot 401, such that the main slot 401 and the extension slot 600 may be connected to each other as one space.

One end portion 510 of the second switching lever 500 may be disposed adjacently to the other end portion 4012 of the main slot 401, and rotate around the shaft 530 to selectively open or close the first and second branch slots 610 and 620.

In detail, one end portion 510 of the second switching lever 500 may rotate around the shaft 530 to be in selective contact with the first inner sidewall 601 and the sixth inner sidewall 606 of the extension slot 600 facing each other, thereby selectively opening or closing the first branch slot 610 and the second branch slot 620.

Figure 14A:
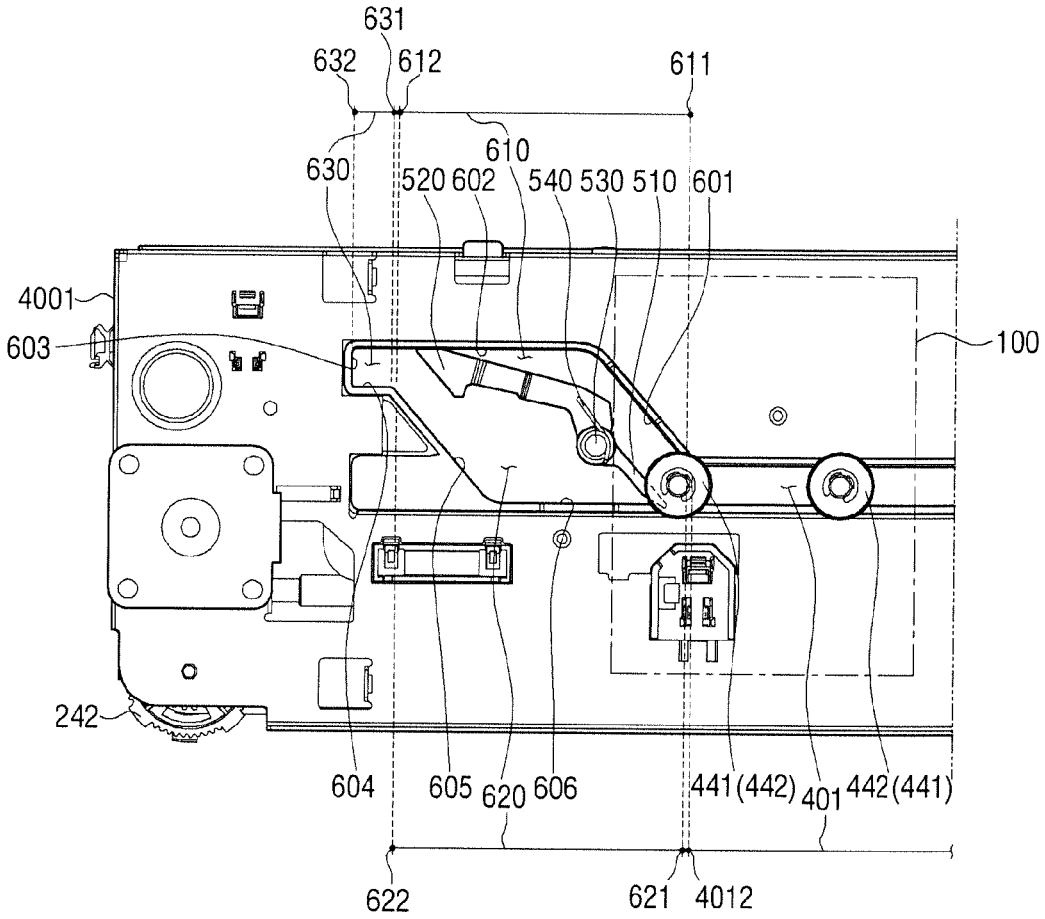
FIGS. 14A to 14D are enlarged views of a form in which the first and second rollers illustrated in FIG. 12 move along the first and second branch slots partitioned through a second switching lever.

As illustrated in FIG. 14A, one end portion 510 of the second switching lever 500 may be in contact with the sixth inner sidewall 606 to open the first branch slot 610 formed between the second switching lever 500 and the first and second inner sidewalls 601 and 602 from the main slot 401 and close the second branch slot 620. In this case, the other end portion 520 of the second switching lever 500 is in contact with the second inner sidewall 602.

A state in which the first branch slot 610 is opened and the second branch slot 620 is closed refers to a state in which the first roller 441 may enter one end portion 611 of the first branch slot 610 and may not enter one end portion 621 of the second branch slot 620.

A second elastic member 540 may be coupled to the shaft 530 of the second switching lever 500, and may apply force to the second switching lever 500 so that one end portion 510 of the second switching lever 500 rotates in a first direction in which it closes the second branch slot 620.

Therefore, as illustrated in FIG. 14A, the first roller 441 may enter one end portion 611 of the opened first branch slot 610 from the other end portion 4012 of the main slot 401.

Figure 14B:
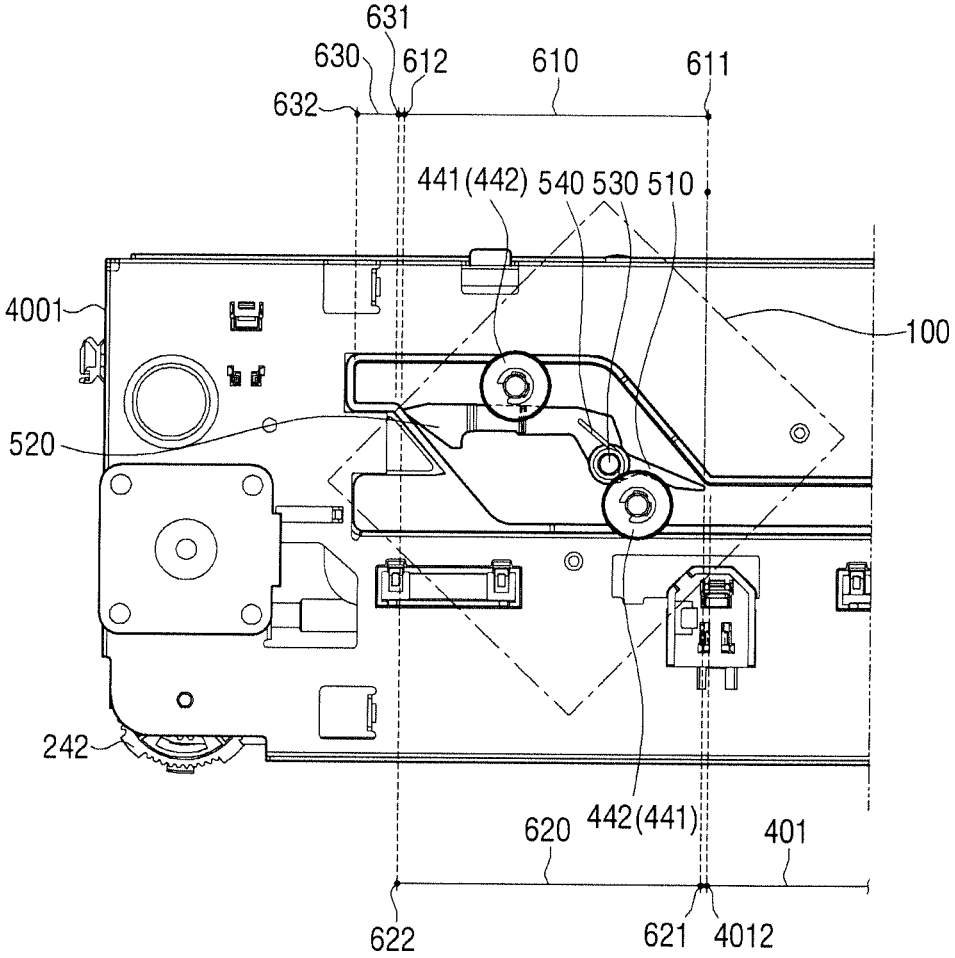

In addition, as illustrated in FIG. 14B, the first roller 441 moving along the first branch slot 610 presses the other end portion 520 of the second switching lever 500, such that the second switching lever 500 may rotate in a second direction in which it closes the first branch slot 610.

Since the second branch slot 620 is opened while the first roller 441 presses the other end portion 520 of the second switching lever 500, the second roller 442 following the first roller 441 enters one end portion 621 of the second branch slot 620.

Therefore, the first roller 441 moves along the first branch slot 610, and the second roller 442 moves along the second branch slot 620, such that the stapler 100 may move in a state in which it is inclined at a predetermined angle.

In addition, the extension slot 600 further may include an accommodating groove 630 disposed adjacently to the other end portion 520 of the second switching lever 500.

As illustrated in FIG. 14A, the accommodating groove 630 may be partitioned by a portion of the second inner sidewall 602, the third inner sidewall 603, and the fourth inner sidewall 604, and is formed so that the first roller 441 may be inserted thereinto.

As illustrated in FIG. 14B, as the first roller 441 presses the other end portion 520 of the second switching lever 500 while moving along the first branch slot 610, the second switching lever 500 maintains a state in which it rotates in the second direction, such that the other end portion 520 of the second switching lever 500 may be in contact with the fifth inner sidewall 605. Therefore, the first branch slot 610 and the accommodating groove 630 may be connected to each other.

Therefore, the first roller 441 moving along the first branch slot 610 may pass through the other end portion 612 of the first branch slot 610, and then move to the accommodating groove 630 through one end portion 631 of the accommodating groove 630.

Figure 14C:
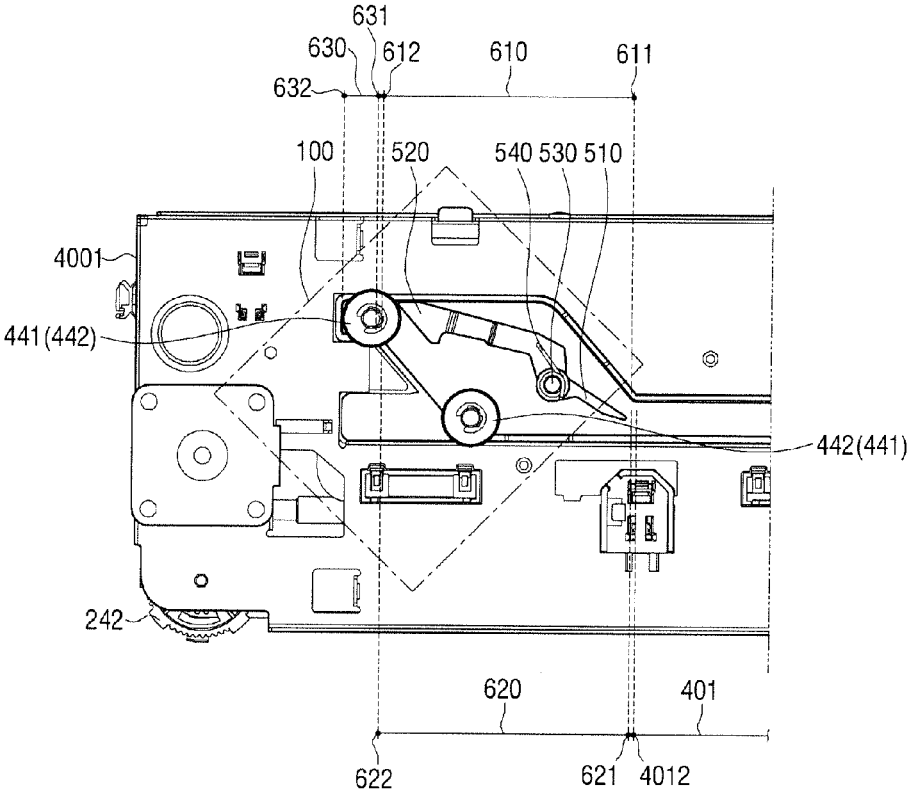

As illustrated in FIG. 14C, when the first roller 441 moves up to the other end portion 632 of the accommodating groove 630 to be accommodated in the accommodating groove 630, the first roller 441 and the other end portion 520 of the second switching lever 500 are spaced apart from each other.

Therefore, the other end portion 520 of the second switching lever 500 is released from being pressed from the first roller 441, such that the second switching lever 500 rotates in the first direction in which it closes the second branch slot 620 by the force applied by the second elastic member 540.

When the second switching lever 500 rotates in the first direction, the other end portion 520 of the second switching lever 500 is again in contact with the second inner sidewall 602, such that the accommodating groove 630 and the second branch slot 620 may be connected to each other.

The accommodating groove 630 and the second branch slot 620 are connected to each other as described above, such that the first roller 441 accommodated in the accommodating groove 630 may move together with the second roller 442 along the second branch slot 620 via the other end portion 622 of the second branch slot 620.

Figure 14D:
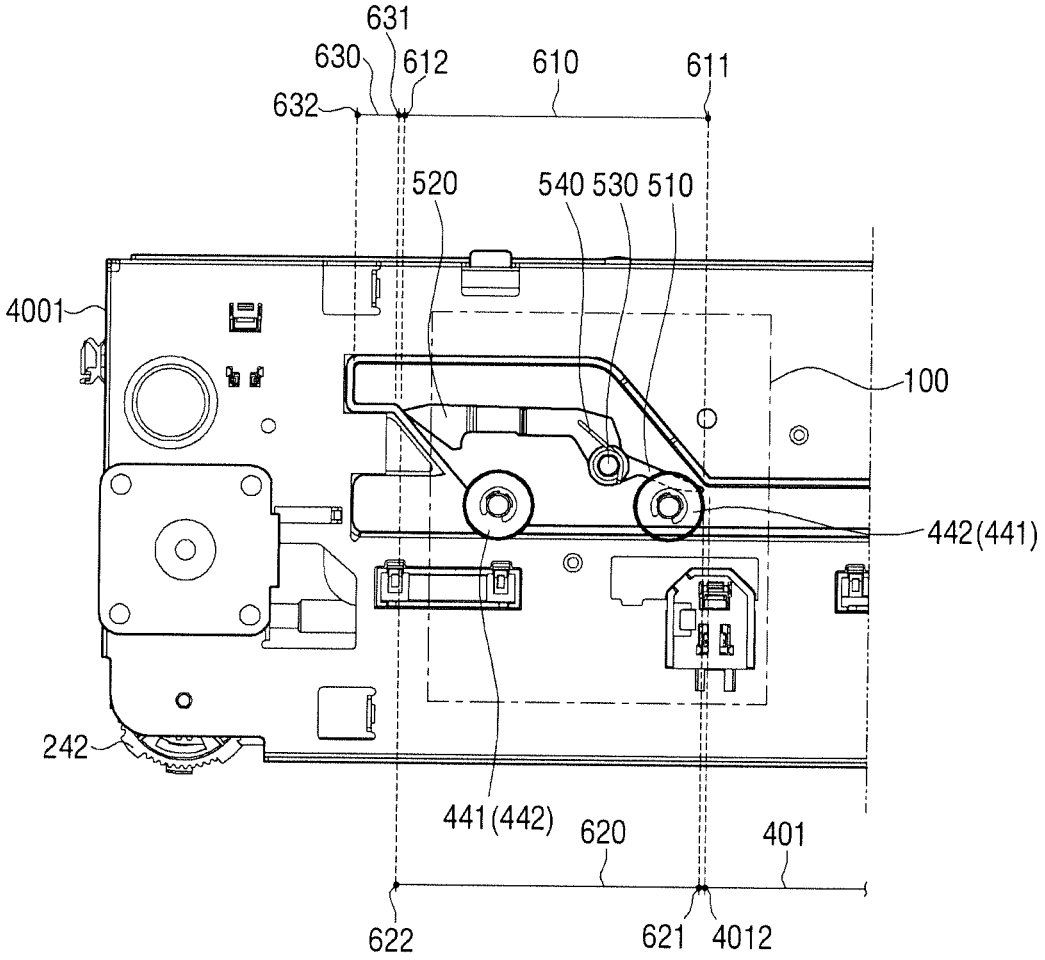

As illustrated in FIG. 14D, the first roller 441 moving toward the main slot 401 along the second branch slot 620 may follow the second roller 442.

In the first and second rollers 441 and 442 moving along the second branch slot 620, the second roller 442 may press one end portion 510 of the second switching lever 500 to open one end portion 621 of the second branch slot 620, enter the main slot 401 through the other end portion 4012 of the main slot 401, and move along the main slot 401.

As described above, the extension slot 600 is partitioned into the first branch slot 610 and the second branch slot 620 through a single second switching lever 500, and the first branch slot 610 and the second branch slot 620 are selectively opened or closed through the rotation of the second switching lever 500, such that a moving path and an angle of the stapler 100 may be variously adjusted. As a result, the stapling apparatus 30 may be configured in a more compact structure.

In addition, the first roller 441 moves from the first branch slot 610 to the second branch slot 620 through the accommodating groove 630, such that the first roller 441 and the second roller 442 move together with each other along the second branch slot 620. As a result, the stapler 100 may move in the horizontal direction extended from the main slot 401.

Although the diverse exemplary embodiments of the disclosure have been individually described hereinabove, the respective exemplary embodiments are not necessarily implemented singly, but may also be implemented so that configurations and operations thereof are combined with those of one or more other exemplary embodiments.

Although the exemplary embodiments of the disclosure have been illustrated and described hereinabove, the disclosure is not limited to the specific exemplary embodiments described above, but may be variously modified by those skilled in the art to which the disclosure pertains without departing from the scope and spirit of the disclosure as claimed in the claims. These modifications should also be understood to fall within the technical spirit and scope of the disclosure.

What is claimed is:

1. A stapling apparatus, comprising:

a stapler;

a driver to be coupled to the stapler and to move the stapler; and a guide part to selectively change a configuration of a moving path so as to define the moving path along which the stapler can be moved by the driver, the guide part including:

a main slot, first and second branch slots branched from one end portion of the main slot, and a switching lever to rotate about a shaft so that one end portion of the switching lever selectively opens or closes one side of each of the first and second branch slots connected to the one end portion of the main slot to selectively change the configuration of the moving path, the shaft being disposed at an other end portion of the switching lever.

2. The stapling apparatus as claimed in claim 1, wherein the another side of each of the first and second branch slots are connected to one another to form a closed loop.

3. The stapling apparatus as claimed in claim 1, wherein the guide part further includes first and second rollers to be coupled to the stapler and to be slidably inserted into the main slot.

4. The stapling apparatus as claimed in claim 3, wherein the first roller is disposed in front of the second roller in a moving direction of the stapler and the first and second rollers move along the first and second branch slots, respectively, and the switching lever further includes an elastic member configured to apply a force to the switching lever so that the switching lever rotates in a first direction in which the switching lever closes the second branch slot.

5. The stapling apparatus as claimed in claim 4, wherein the switching lever further includes a protrusion part to protrude from the other end portion of the switching lever toward an inner side of the first branch slot, and the protrusion part is to be pressed by the first roller entering the first branch slot, such that the switching lever rotates a second direction in which the switching lever closes the first branch slot.

6. The stapling apparatus as claimed in claim 5, wherein the other end portion of the first branch slot and the other end portion of the second branch slot are connected to each other so that the first branch slot and the second branch slot form a closed loop, and the first roller sequentially moves along the main slot, the first branch slot, the second branch slot, and the main slot.

7. The stapling apparatus as claimed in claim 6, wherein the guide part further includes a blocking lever to open or close the other end portion of the first branch slot, and the blocking lever blocks the first roller from entering the first branch slot from the second branch slot.

8. The stapling apparatus as claimed in claim 1, wherein the first branch slot is inclined from the main slot.

9. The stapling apparatus as claimed in claim 8, wherein the first branch slot includes at least one bent section.

10. The stapling apparatus as claimed in claim 1, wherein the second branch slot extends along in a same direction as that of the main slot.

11. The stapling apparatus as claimed in claim 1, wherein the switching lever includes an elastic member coupled to the shaft to apply a force to the switching lever so that the switching lever rotates in a direction in which the switching lever closes the one side of the second branch slot.

12. The stapling apparatus as claimed in claim 1, wherein the guide part further includes a rotation driving unit to rotate the switching lever.

13. The stapling apparatus as claimed in claim 12, wherein the rotation driving unit includes:

a connection member to have one end portion of the connection member coupled to the shaft of the switching lever; and a solenoid to be coupled to an other end portion of the connection member.

14. The stapling apparatus as claimed in claim 12, wherein the guide part further includes:

third and fourth branch slots to be branched from an other end portion of the main slot, and another switching lever to selectively change the configuration of the moving path by selectively opening or closing the third and fourth branch slots.

15. The stapling apparatus as claimed in claim 12, further comprising a controller to control an operation of the rotation driving unit, wherein the guide part further includes first and second rollers to be coupled to the stapler and to be slidably inserted into the main slot, and the controller controls the rotation driving unit so that the switching lever rotates in a direction in which the switching lever closes the first branch slot when the first roller disposed in front of the second roller in a moving direction of the stapler enters the first branch slot.

16. A stapling apparatus, comprising:

a stapler;

a driver to be coupled to the stapler and to move the stapler; and a guide part to selectively change a configuration of a moving path so as to define the moving path along which the stapler can be moved by the driver, the guide part including:

a main slot, an extension slot to be extended from the main slot, and a switching lever to be rotatably disposed in the extension slot, having opposite end portions in selective contact with inner sidewalls of the extension slot to partition the extension slot into a first branch slot and a second branch slot.

17. The stapling apparatus as claimed in claim 16, wherein the guide part further includes first and second rollers to be coupled to the stapler and to be slidably inserted into the main slot, and the first roller is disposed in front of the second roller in a moving direction of the stapler.

18. The stapling apparatus as claimed in claim 16, wherein the switching lever includes an elastic member to apply a force to the switching lever so that the switching lever rotates in a direction in which the switching lever closes.

19. The stapling apparatus as claimed in claim 16, wherein one end portion of the switching lever adjacent to the main slot is in selective contact with inner sidewalls of the extension slot facing each other depending on rotation of the switching lever so as to selectively change the configuration of the moving path by selectively opening or closing the first and second branch slots.

20. An image forming apparatus, comprising:

a body having an image former; and a stapling apparatus to staple printing media discharged from the image former, the stapling apparatus including:

a stapler;

a driver to move the stapler; and a guide part to guide the stapler when the driver moves the stapler, the guide part including:

a main slot, first and second branch slots to be branched from one end portion of the main slot, and a switching lever to rotate about a shaft so that one end portion of the switching lever selectively opens or closes one side of each of the first and second branch slots connected to the one end portion of the main slot so that the driver can selectively move the stapler from the main slot to the first and second branch slots, the shaft being disposed at an other end portion of the switching lever.

* * * * *